US005283573A

United States Patent [19]

Takatou et al.

[11] Patent Number: 5,283,573

[45] Date of Patent: Feb. 1, 1994

[54] TRAFFIC FLOW MEASURING METHOD AND APPARATUS

[75] Inventors: Masao Takatou, Katsuta; Kazunori Takahashi, Hitachi; Nobuhiro Hamada, Hitachiota; Tadaaki Kitamura, Hitachi; Kuniyuki Kikuchi, Hitachiota; Hiroshi Takenaga, Tokai; Yasuo Morooka, Hitachi, all of Japan

[73] Assignee: Hitachi, Ltd., Tokyo, Japan

[21] Appl. No.: 692,718

[22] Filed: Apr. 29, 1991

[30] Foreign Application Priority Data

Apr. 27, 1990 [JP] Japan ..... 2-110075
Jan. 18, 1991 [JP] Japan ..... 3-4241

[51] Int. Cl.[5] ..... G08G 1/017

[52] U.S. Cl. ..... 340/937; 340/934; 346/107 VP

[58] Field of Search ..... 340/917, 919, 920, 922, 340/928, 934, 937, 935, 936; 364/436, 437; 358/105, 113; 346/107 VP

[56] References Cited

U.S. PATENT DOCUMENTS 2,710,390 6/1955 Forse ..... 340/937
3,663,937 5/1972 Bolner ..... 340/937
4,839,648 6/1989 Beucher et al. ..... 340/937
4,847,772 7/1989 Michalopoulos et al. ..... 340/937
4,884,072 11/1989 Horsch ..... 340/937
5,041,828 8/1991 Loeven ..... 340/937
5,066,950 11/1991 Schweitzer et al. ..... 340/936

FOREIGN PATENT DOCUMENTS 0249783 9/1987 Fed. Rep. of Germany ..... 340/937
3820520 12/1989 Fed. Rep. of Germany ..... 340/937
0010111 1/1985 Japan ..... 340/937
0281598 11/1989 Japan ..... 340/937

*Primary Examiner*—Brent A. Swarthout
*Attorney, Agent, or Firm*—Antonelli, Terry, Stout & Kraus

[57] ABSTRACT

This invention relates to a method an apparatus for measuring traffic flows or in other words, the flows of vehicles, inside and near a crossing, and is directed to provide method and apparatus capable of extracting vehicles with a high level of accuracy.

Overlap of vehicles can be avoided by setting the field of a camera not to a range from the inflow portion to the vicinity of center of the crossing, but to a range from the center to the vicinity of the outflow portion (151) of the crossing. Accordingly, accuracy of traffic flow measurement can be improved.

38 Claims, 24 Drawing Sheets

FIG. 18

55

| BLOCK COORDINATE $P_{ij}$ | POINTER FOR VEHICLE INFORMATION TABLE |
|---|---|
| $P_{11}$ | |
| $P_{12}$ | |
| | |
| $P_{34}$ | $V_5(t)$ |
| $P_{35}$ | $V_6(t)$ |
| | |
| $P_{54}$ | |

| | x COORDINATE | y COORDINATE | ATTITUDE (DIRECTION) |
|---|---|---|---|
| $V_1(t)$ | 115 | 20 | 1 |
| $V_2(t)$ | 172 | 25 | 0 |
| $V_3(t)$ | 76 | 80 | 0 |
| $V_4(t)$ | 210 | 75 | 0 |
| $V_5(t)$ | 185 | 125 | 3 |
| $V_6(t)$ | 250 | 125 | 0 |
| $V_7(t)$ | 175 | 200 | 2 |
| ≈ | | | |
| | | | |
| $V_m(t)$ | | | |

FIG. 21

51

| | EFFECTIVE FLAG | EXISTENCE START | | PRESENT STATE | | | | |
|---|---|---|---|---|---|---|---|---|
| | | TIME | BLOCK COORDINATE | BLOCK COORDINATE | x COOR-DINATE | y COOR-DINATE | DISPLACEMENT DISTANCE | LOCUS POINT |
| $V_7(t_0)$ | ON | $t_{-3}$ | $P_{35}$ | $P_{54}$ | 175 | 240 | 175 | 35 7 / 0 10 |
| $V_6(t_0)$ | ON | $t_{-2}$ | $P_{35}$ | $P_{44}$ | 175 | 155 | 90 | 25 3 / 0 10 |
| $V_5(t_0)$ | ON | $t_0$ | $P_{35}$ | $P_{35}$ | 225 | 125 | 0 | 10 0 / 0 5 |
| | | | | | | | | |

FIG. 22

51

| | EFFECTIVE FLAG | EXISTENCE START | | PRESENT STATE | | | | |
|---|---|---|---|---|---|---|---|---|
| | | TIME | BLOCK COORDINATE | BLOCK COORDINATE | x COORDINATE | y COORDINATE | DISPLACEMENT DISTANCE | LOCUS POINT |
| $V_7(t_0) \rightarrow$ | OFF | $t_{-3}$ | $P_{35}$ | $P_{54}$ | 175 | 240 | 175 | 35/0 ; 7/10 |
| $V_6(t_0) \rightarrow V_7(t)$ | ON | $t_{-2}$ | $P_{35}$ | $P_{44}$ | 175 | 200 | 130 | 35/0 ; 5/10 |
| $V_5(t_0) \rightarrow V_5(t)$ | ON | $t_0$ | $P_{35}$ | $P_{34}$ | 185 | 125 | 40 | 15/0 ; 1/10 |
| $V_6(t)$ | ON | $t$ | $P_{35}$ | $P_{35}$ | 250 | 125 | 0 | 10/0 ; 0/5 |
| | | | | | | | | |

FIG. 23A

11

54

| | | | | |
|---|---|---|---|---|
| 0 5<br>0 5 | 0 5<br>0 5 | 0 0<br>0 5 | 0 0<br>0 5 | 0 0<br>0 10 |
| 0 5<br>0 5 | 0 8<br>0 5 | 0 5<br>0 5 | 5 0<br>0 5 | 5 0<br>0 10 |
| 0 4<br>0 5 | 0 8<br>0 5 | 2 5<br>0 5 | 5 1<br>0 5 | 10 0<br>0 5 |
| 0 3<br>0 0 | 2 10<br>0 0 | 5 5<br>0 0 | 10 2<br>0 0 | |
| 0 2<br>0 0 | 4 10<br>0 0 | 5 5<br>0 0 | 10 4<br>0 0 | |

FIG. 23B

| | |
|---|---|
| LEFT TURN | RIGHT TURN |
| STRAIGHT RUN | OTHER |

FIG. 24

11

54

| | | | | |
|---|---|---|---|---|
| 0 5<br>0 5 | 0 5<br>5 5 | 0 0<br>5 5 | 0 0<br>5 5 | 0 0<br>0 5 |
| 0 5<br>0 5 | 0 8<br>5 5 | 0 5<br>5 5 | 1. 0<br>5 5 | 1 0<br>0 5 |
| 0 4<br>0 5 | 0 8<br>4 5 | 2 5<br>4 5 | 5 1<br>4 5 | 5 0<br>0 5 |
| 0 3<br>0 5 | 2 10<br>0 0 | 5 5<br>0 0 | 10 2<br>0 0 | |
| 0 2<br>0 5 | 4 10<br>0 0 | 5 5<br>0 0 | 10 4<br>0 0 | |

| | | |
|---|---|---|
| UPPER LEFT | UPPER | UPPER RIGHT |
| LEFT | IDEN-TICAL PLACE | RIGHT |
| LOWER LEFT | LOWER | LOWER RIGHT |

TRAFFIC FLOW MEASURING METHOD AND APPARATUS

BACKGROUND OF THE INVENTION

This invention relates to a method and apparatus for measuring traffic flows or in other words, the flows of vehicles, inside and near a crossing The present invention relates also to a technique which utilizes the result of measurement obtained by the invention for the structural design of crossings, such as signal control, disposition of right turn-only signal, a right turn lane, a left turn preferential lane, and so forth.

Conventional traffic flow measurement has been carried out by disposing a camera above a signal light, taking the images of vehicles flowing into a crossing at the time of a green signal by one camera and measuring the number and speeds of the vehicles as described, for example, in "Sumitomo Denki", Vol. 130 (March, 1987), pp. 26–32. In this instance, a diagonal measurement range is set to extend along right and left turn lanes and brightness data of measurement sample points inside the measurement range are processed in various ways so as to measure the number and speeds of the vehicles.

However, the conventional system described above does not take sufficiently into consideration the overlap of vehicles and is not free from the problem that extraction and tracking of vehicles cannot be made sufficiently because smaller vehicles running beside larger vehicles are hidden by the latter and larger vehicles which are turning right, or about to turn right, hide opposed smaller vehicles which are also turning right.

The prior art system has another problem that the traffic flow cannot be accurately determined at a transition from yellow light to red light because the system checks only the vehicles entering the crossing at the green light.

SUMMARY OF THE INVENTION

It is an object of the present invention to provide a high precision traffic flow measuring system which can extract vehicles with a high level of accuracy by avoiding the overlap of vehicles inside the field of a camera.

It is another object of the present invention to provide a high precision traffic flow measuring apparatus which improves tracking accuracy of vehicles by setting dynamically the moving range of each vehicle.

It is still another object of the present invention to provide an accurate device for measuring traffic flows, which employs flow equations taking account of both the transition of signal phase and time delay.

It is still another object of the present invention to provide a smooth traffic flow by controlling the cycle time, split time and offset time of a signal by use of the result of a high precision traffic flow measurement.

It is still another object of the present invention to support a structural design of a crossing to match the traffic condition of the crossing by effecting the structural design of the crossing such as disposition of a right turn-only signal and setting of a right turn lane, a left turn preferential lane, etc, by use of statistical data of the result of the high precision traffic flow measurement.

It is a further object of the present invention to make it possible to track vehicles at a crossing while reflecting the traffic condition of the crossing by executing learning by use of on-line measurement data, to shorten the processing time and to improve measurement accuracy.

One of the characterizing features of the present invention resides in that the field of a camera is set to a range from the center of a crossing to the vicinity of its outflow portion but not to a range from the inflow portion to the vicinity of the center of the crossing.

Another characterizing feature of the present invention resides in that the presence of right turn vehicles, left turn vehicles and straight run vehicles is estimated in accordance with the colors (green, yellow, red) of a signal by receiving a phase signal from traffic signal controller and a moving range data which is different from vehicle to vehicle is provided dynamically in order to improve tracking accuracy of vehicles.

Still another characterizing feature of the present invention resides in that data from other traffic flow measuring apparatuses (other measuring instruments, vehicle sensors, etc) are used so as to check any abnormality of the measuring instrument (camera, traffic flow controller, etc).

Still another characterizing feature of the present invention resides in that in order to avoid the overlap of vehicles inside the field of a camera, the camera is installed at a high position or above the center of a crossing so that the crossing can be covered as a whole by the field of one camera.

Still another characterizing feature of the present invention resides in that $2n$ cameras are used in an n-way crossing, the field of one camera is set so as to cover the inflow portion to the vicinity of the center of the crossing and the field of another camera is set near at the opposed center of the crossing for the same group of vehicles.

Still another characterizing feature of the present invention resides in that a vehicle locus point table and a vehicle search map in accordance with time zones which take the change of the phase of a traffic signal into consideration are used in order to improve vehicle tracking accuracy.

Still another characterizing feature of the present invention resides in that a vehicle locus point table and a vehicle search map are generated automatically by executing learning by use of data at the time of on-line measurement in order to improve vehicle tracking accuracy and to make generation easier.

Still another characterizing feature of the present invention resides in that the total number of vehicles (the number of left turn vehicles, the number of straight run vehicles and the number of right turn vehicles) in each direction of each road is determined by determining the inflow quantity (the number of inflowing vehicles), the outflow quantity (the number of outflowing vehicles) and the number of left turn or right turn vehicles of each road corresponding to a time zone associated with a phase of a traffic signal controller in order to improve measurement accuracy of the number of vehicles, mean speed, and the like.

Still another characterizing feature of the present invention resides in that system control or point responsive control of a traffic signal is carried out on an on-line basis by a traffic control computer and the traffic controller on the basis of the measurement result by a traffic flow measuring apparatus main body in order to make smooth the flow of vehicles at a crossing.

Still another characterizing feature of the present invention resides in that review of each parameter value such as a cycle, a split, an offset and necessity for the disposition of a right turn lane, a left turn preferential lane and a right turn-only signal are judged on an off-line basis by processing statistically the result of the traffic flow measurement by a traffic control computer in order to make smooth the flow of vehicles at a crossing.

Still another characterizing feature of the present invention resides in that the processing speed is improved by making a camera and an image processing unit or a traffic flow measuring apparatus main body correspond on a 1:1 basis in order to improve vehicle measuring accuracy.

Still another characterizing feature of the present invention resides in that the field of a camera is set to a range from the center to the vicinity of the outflow portion of a crossing in such a manner as not to include the signal inside the field in order to improve vehicle measuring accuracy.

Still another characterizing feature of the present invention resides in that the field of a camera is set in such a manner as not to include a signal and a pedestrian crossing but to include a stop line of vehicles, at the back of the stop line on the inflow side of the crossing in order to improve vehicle measuring accuracy.

Still another characterizing feature of the present invention resides in that the field of a camera is set in such a manner as not to include a signal and a pedestrian crossing, ahead of the pedestrian crossing on the outflow side of the crossing in order to improve vehicle measuring accuracy.

Still another characterizing feature of the present invention resides in that processing is conducted while an unnecessary region inside the field of the camera is excluded by mask processing and window processing in order to improve vehicle measuring accuracy.

BRIEF DESCRIPTION OF THE DRAWINGS

FIG. 18 is an explanatory view useful for explaining a vehicle data index table in accordance with still another embodiment of the present invention;

FIG. 21 is an explanatory view useful for explaining a vehicle registration table before updating;

FIG. 22 is an explanatory view useful for explaining the vehicle registration table after updating;

FIGS. 23A and 23B are explanatory views useful for explaining a vehicle orbit point table;

FIG. 24 is an explanatory view useful for explaining the vehicle orbit point table;

DESCRIPTION OF THE PREFERRED EMBODIMENTS

Figure 29:
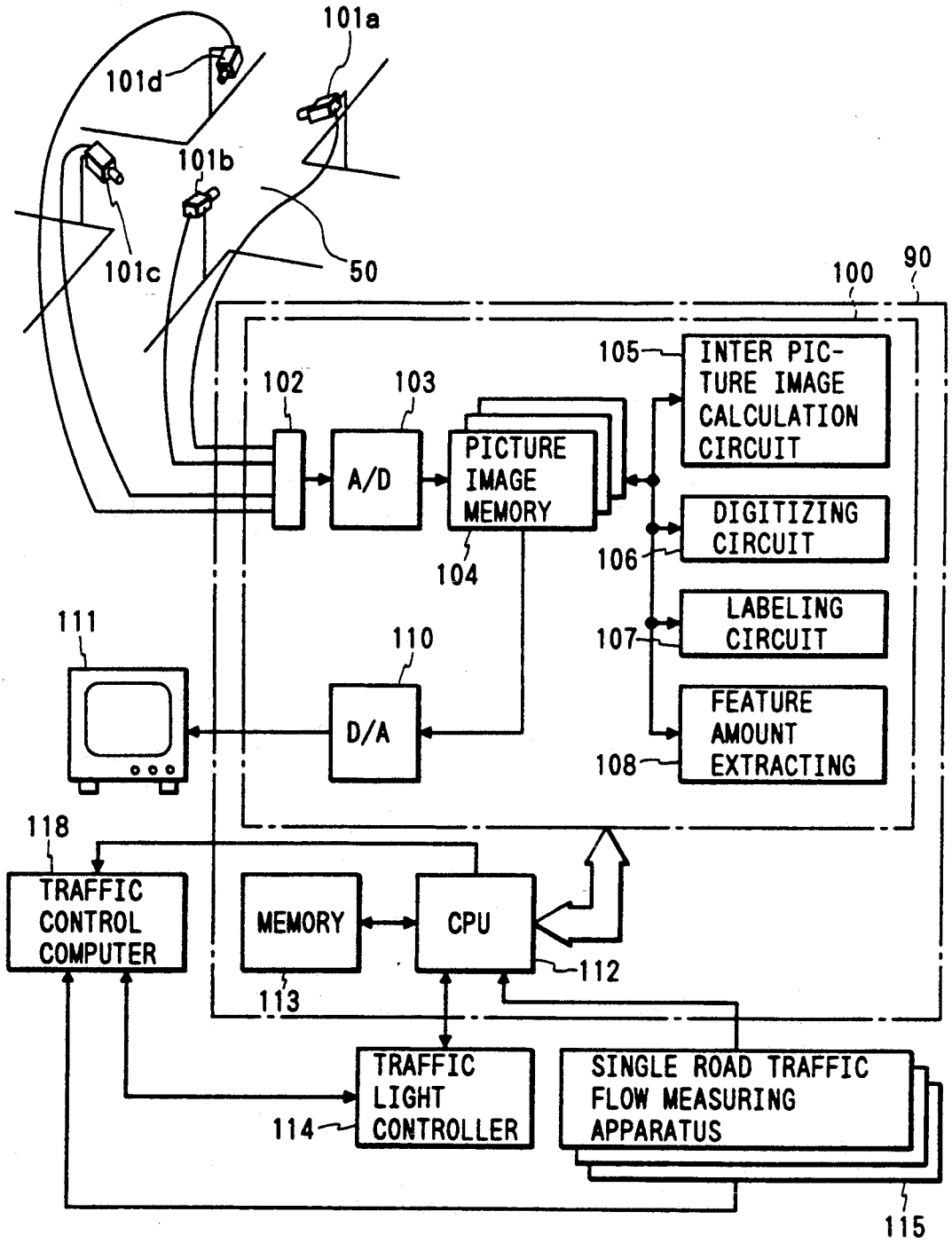
FIG. 29 is a block diagram showing the structure of a traffic flow measuring apparatus.

Hereinafter, a first embodiment of the present invention will be explained with reference to FIG. 29.

A traffic flow measuring apparatus in accordance with this embodiment includes a traffic flow measuring apparatus main body 90 for processing images which are taken by cameras 101*a*, 101*b*, 101*c*, 101*d* near a crossing 50 for measuring traffic flow and a monitor 111 for displaying the images and various data.

The traffic flow measuring apparatus main body 90 comprises an image processing unit 100 for extracting the characteristic quantities of objects from the inputted images, CPU 112 for controlling the apparatus as a whole, for processing the processing results of the image processing unit 100 and for processing the phase signal of a traffic signal controller 114 and data from a measuring device 115 for uninterrupted traffic flows, and a memory 113 for storing the results of measurement, and the like.

The image processing unit 100 is equipped with a camera switch 102, an A/D convertor 103, an image memory 104, an inter-image operation circuit 105, a binary-coding circuit 106, a labelling circuit 107, a characteristic quantity extraction circuit 108 and a D/A convertor 110.

The image memory 104 is equipped with k density memories G1 - Gk of a 256×256 pixel structure, for example, and is equipped, whenever necessary, with l binary image memories B1 - Bl for storing binary images.

Next, the operation will be explained.

The image processing unit 100 receives the image signals taken by the cameras 101*a*–101*d* on the basis of an instruction from CPU 112, selects the input from one of the four cameras by way of the camera switch 102, converts the signals to density data of 128 tone wedges, for example, by the A/D convertor 103 and stores the data in the image memory 104.

Furthermore, the image processing unit 100 executes various processings such as inter-image calculation, digitization, labelling, characteristic quantity extraction, and the like, by the inter-image operation circuit 105, the binary-coding circuit 106, the labelling circuit 107, the characteristic feature extraction circuit 108, and the like, respectively, converts the results of processings to video signals by the D/A convertor 110, whenever necessary, and displays the video signals on the monitor 111. Subsequently, CPU 112 executes a later-appearing measuring processing 31, determines a traffic flow measurement result (the number of left turn vehicles, the number of straight run vehicles and the number of right turn vehicles each entering a crossing from each road in a certain time zone) and sends the results to both, or either one of, a traffic control computer 118 and a traffic signal controller 114. When the results of measurement are sent only to the traffic control computer 118, the computer 118 calculates a selection level of the control pattern from the traffic flow measurement results, selects each of the cycle, split and offset patterns corresponding to this selection level, converts the selected pattern to real time values and outputs an advance pulse to the traffic signal controller 114 in accordance with a step time limit display which determines a signal display method. The signal controller 114 changes the display of the signal 95 on the basis of this pulse (in the case of the system control of the traffic signal). On the other hand, when the results of measurement from CPU 112 are sent to the signal controller 114, the signal controller 114 executes the same processing as that of the traffic control computer 118 on the basis of the measurement results, generates by itself the count pulse and changes the display of the signal 95 by this pulse or changes the display of the signal 95 by a conventional point response control on the basis of the measurement result ("Point Control of Signal" edited by Hiroyuki Okamoto, "Management and Operation of Road Traffic", pp. 104–110, Gijutsu Shoin, Oct. 31, 1987).

The traffic flow measurement results sent to the traffic control computer 118 are collected for a certain period and are processed statistically inside the computer. This statistical data can be utilized on an off-line basis and can be used for reviewing the parameter value of each of cycle, split and offset and can be used as the basis for the judgement whether or not a right turn lane, a left turn preferential lane or right turn-only signal should be disposed.

Figure 31:
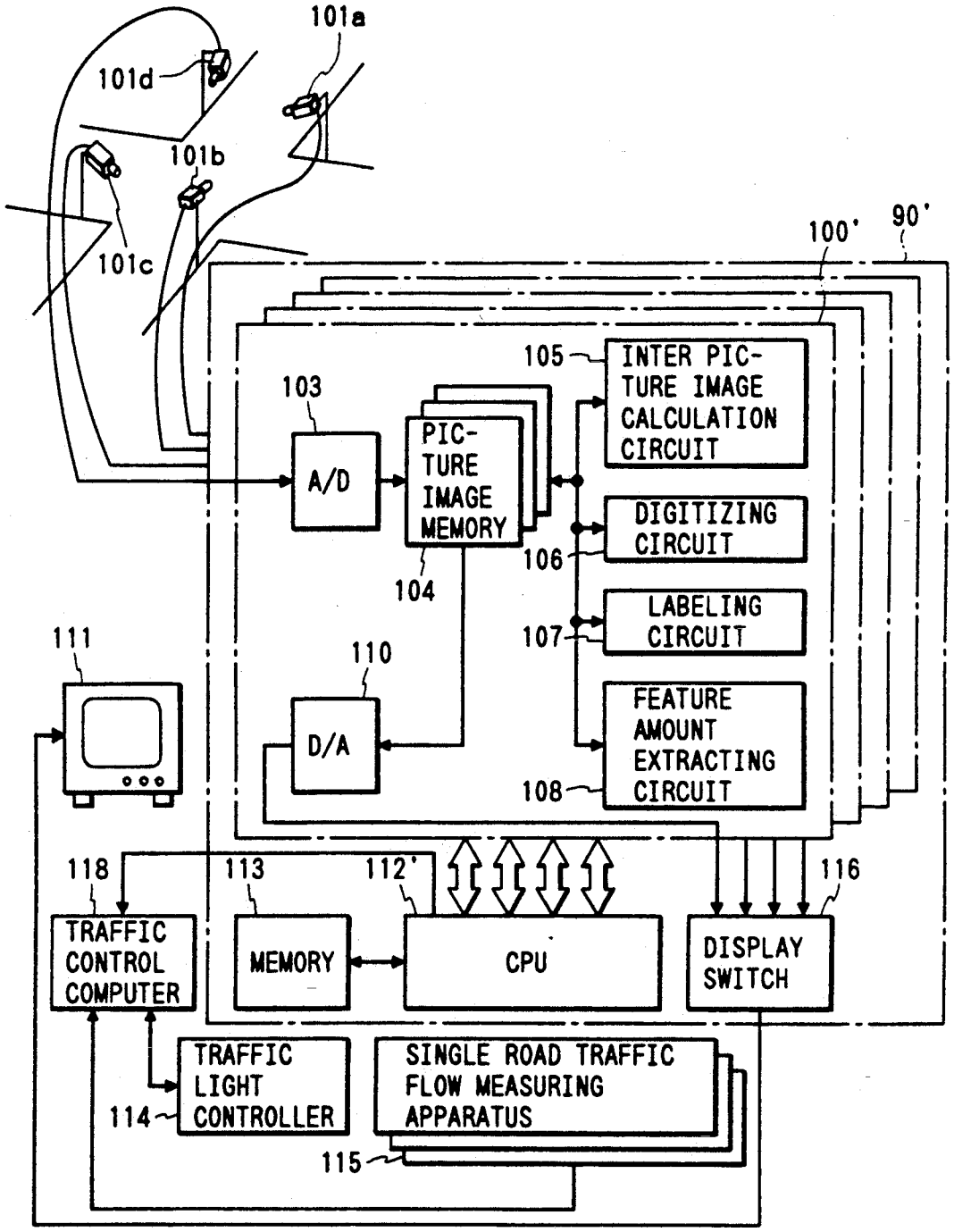
FIG. 31 is a view showing another system configuration of the present invention.

FIG. 31 shows another system configuration. The traffic flow measuring apparatus main body 90' inputs the image of each camera 101*a*–101*d* to an image processor 100' corresponding to each camera (an image processor 100 not including the camera switch 102), and sends the result of each image processing to CPU112'. CPU112' determines the total number of traffic flow vehicles, the vehicle speeds, and the like, and displays the image of the processing results, etc, on the monitor 111 through the display switch 116.

Figure 32:
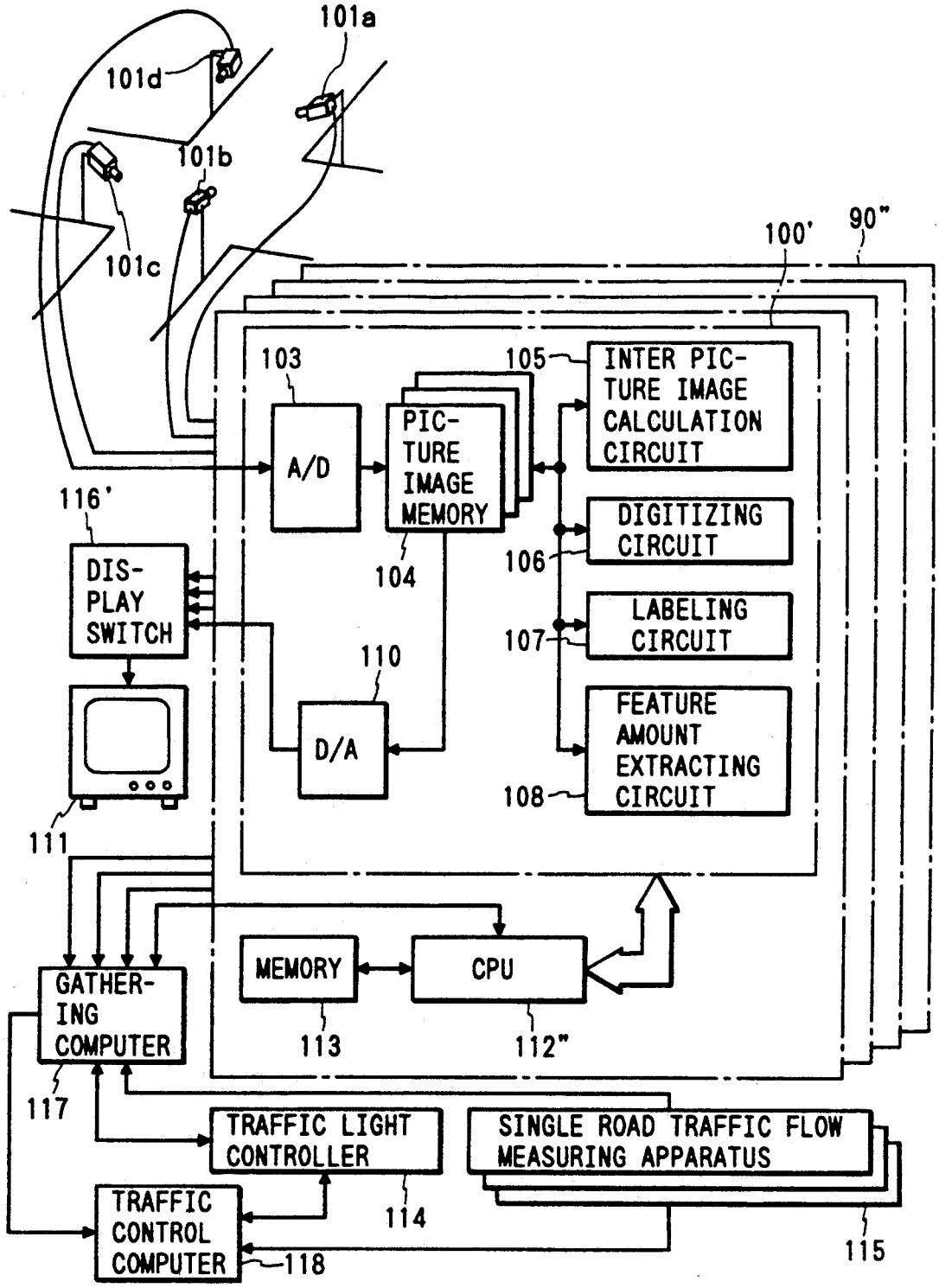
FIG. 32 is a view showing still another system configuration of the present invention.

FIG. 32 shows still another system configuration. Image processing is effected by the traffic flow measuring apparatus main body 90'' corresponding individually to each camera 101*a*–101*d*, and CPU112'' measures the flow of the vehicles corresponding to the input image of each camera and gathers and sends the results altogether to the computer 117. The gathering computer 117 determines the overall traffic flows by use of the processing results from each traffic flow measuring apparatus main body 90'' by referring, whenever necessary, to the phase signal from the traffic signal controller 114 and the data from a single road traffic flow measuring apparatus 115 such as a vehicle sensor. The image of the processing result, or the like, is displayed on the monitor 111 through the display switch 116'. Incidentally, the method of changing the signal display of the signal 95 on the basis of the measurement result is the same as in the case of FIG. 29. The single road traffic flow measuring apparatus 115 is an apparatus which measures the number of straight run vehicles and their speeds in a road having ordinary lanes. A traffic flow measuring apparatus using a conventional vehicle sensor and a conventional ITV camera or the traffic flow measuring apparatus of the present invention can be applied to this application.

Next, the vehicle extraction using the background images and the measuring processing of the flow of vehicles will be described briefly.

Figure 30:
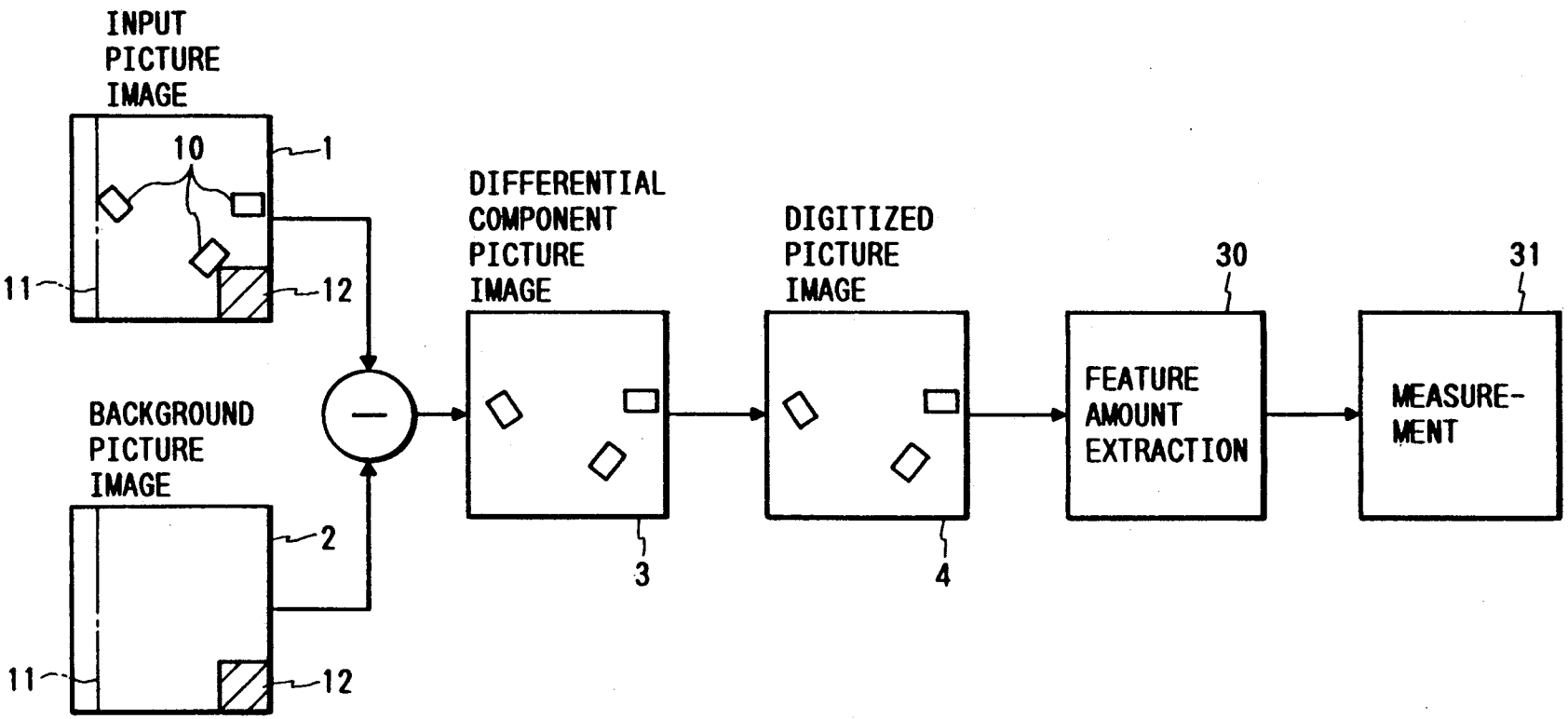
FIG. 30 is an explanatory view useful for explaining the flow of a traffic flow measuring processing.

FIG. 30 is a conceptual view of this vehicle extraction processing. First of all, the image processing unit 100 determines the difference image 3 between the input image 1 and the background image 2, converts the difference image into binary data with respect to a predetermined threshold value to generate a binary image 4, labels each object by labelling and extracts (30) the characteristic quantities such as an area, coordinates of centroid, posture (direction), and so forth. Next, CPU 112 judges an object having an area within a predetermined range as the vehicle, stores its coordinates of centroid as the position data for this vehicle in the memory 113, tracks individual vehicles by referring to the position data of each vehicle stored in the memory 113 and measures the numbers of right turn vehicles, left turn vehicles and straight run vehicles and their speeds (31). Incidentally, reference numeral 10 in the input image 1 represents the vehicles, 11 is a center line of a road and 12 is a sidewalk portion.

Next, the detail of the setting method of the field of the camera as the gist of the present invention will be explained with reference to FIG. 1.

Figure 1:
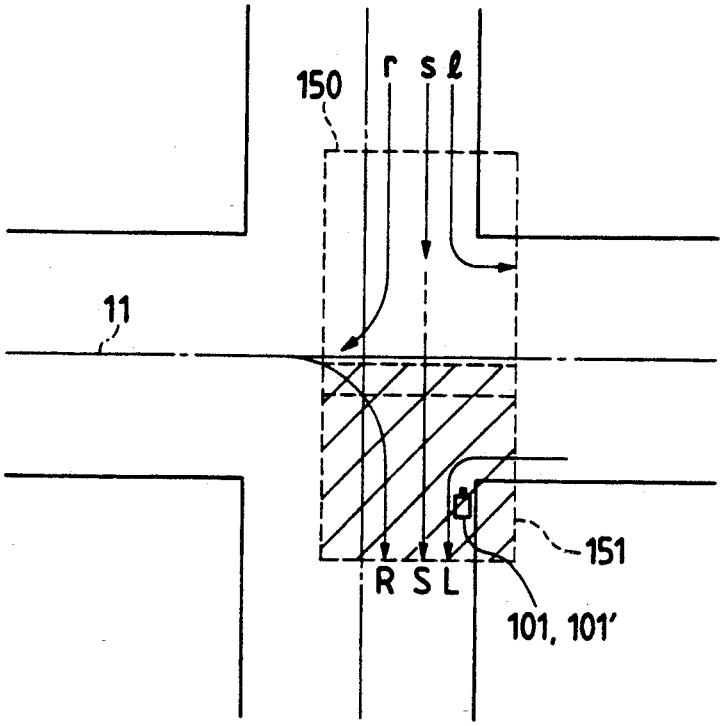
FIG. 1 is a view showing a setting method of the field of a camera in accordance with one embodiment of the present invention.

FIG. 1 is a plan view near a crossing.

In the conventional traffic flow measuring apparatus, the field 150 of the camera 101 is set to the range from the inflow portion of a crossing near to its center portion as represented by the area encompassed by a dash line so as to measure the flows of vehicles entering the crossing (right turn vehicles r, straight run vehicles s, left turn vehicles l). In contrast, the present invention sets the field 151 of the camera 101' to the range from the center of the crossing near to its outflow portion as represented by a hatched area so as to measure the flows of vehicle flowing into the crossing and then flowing out therefrom (right turn vehicles R, straight run vehicles S, left turn vehicles L).

Figure 2:
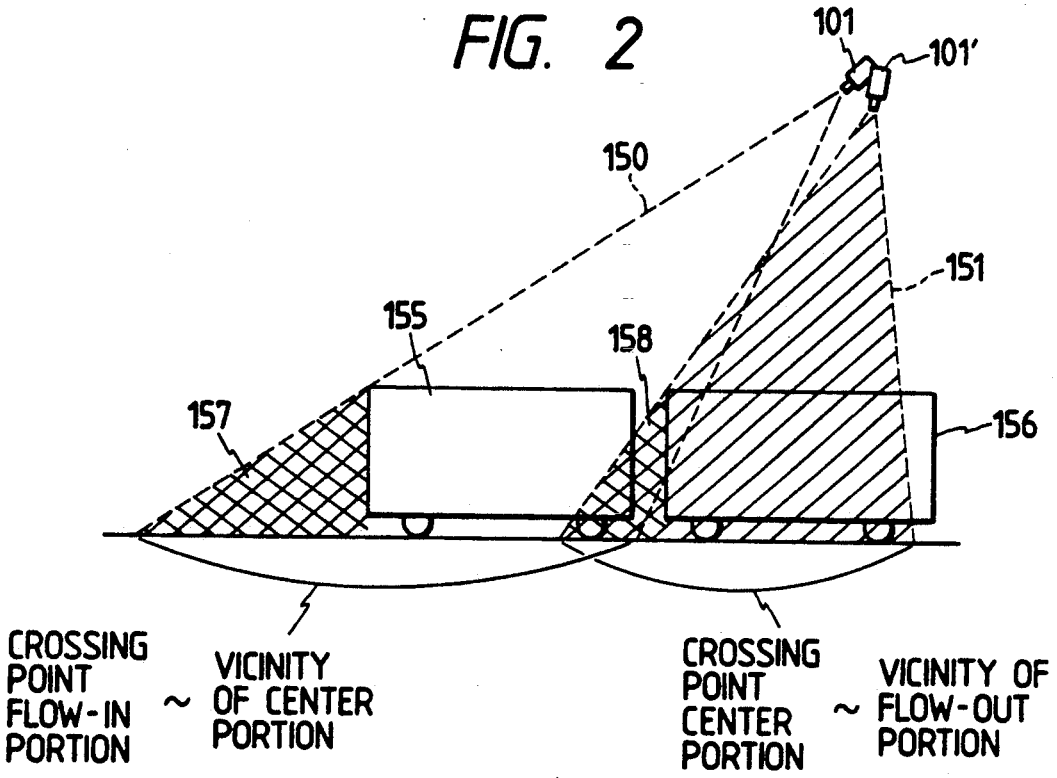
FIG. 2 is a view showing also the setting method of the field of a camera in accordance with one embodiment of the present invention.
Figure 3:
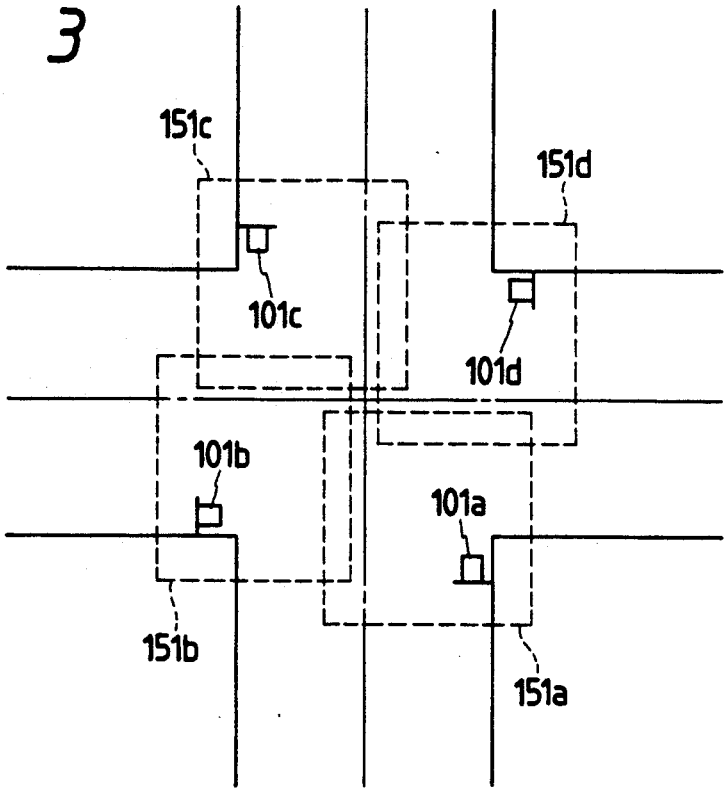
FIG. 3 is a view also showing the setting method of the field of a camera in accordance with one embodiment of the present invention.
Figure 4:
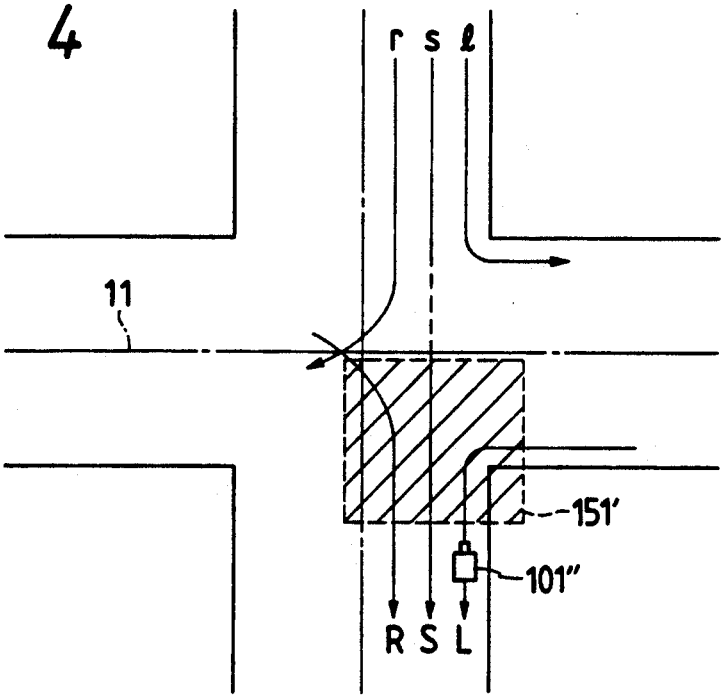
FIG. 4 is a view showing also the setting method of the field of a camera in accordance with one embodiment of the present invention.

FIG. 2 is a side view near the crossing. If the vehicles 155, 156 exist inside the fields 150, 151, respectively, as shown in the drawing, hidden portions 157, 158 represented by a net pattern occur, respectively. FIG. 3 shows the relation between the cameras and their fields when the present invention is applied to a crossing of four roads. The fields of the cameras 101*a*, 101*b*, 101*c* and 101*d* are 151*a*, 151*b*, 151*c* and 151*d*, respectively. If the field of the camera 101' is set to 151 when the camera 101' is set above the signal light, the signal enters the field and processings such as extraction of vehicles and tracking become difficult. Therefore, the field 151' of the camera 101'' is set to the area encompassed by the hatched frame shown in FIG. 4.

Figure 5:
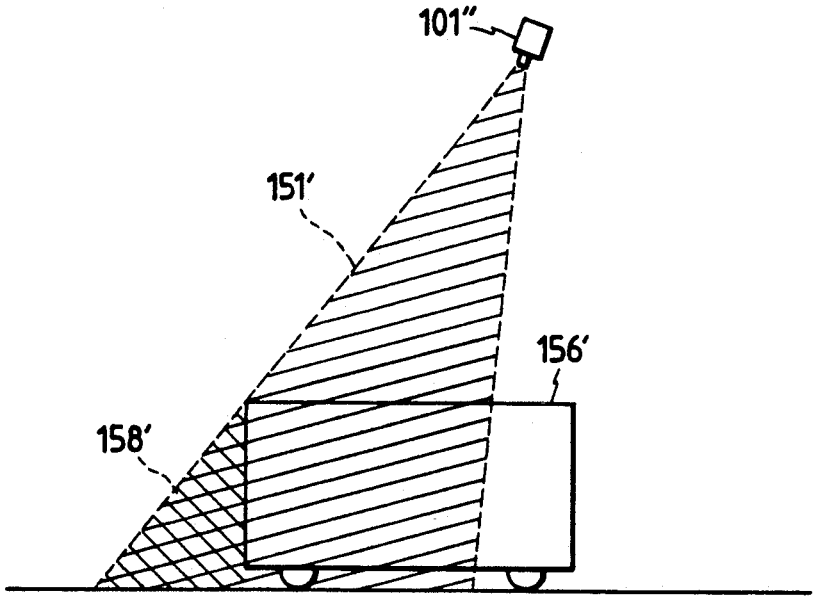
FIG. 5 is a view showing also the setting method of the field of a camera in accordance with one embodiment of the present invention.

Similarly, the side view near the crossing becomes such as shown in FIG. 5 and a hidden portion 158' of the vehicle 156' somewhat occurs. As can be seen clearly from FIGS. 2 and 5, this embodiment sets the field of the camera to the area extending from the center portion of the crossing to its outflow portion, which reduces more greatly the portions hidden by the vehicles 155, 156 or in other words, the overlap between the vehicles inside the field, than when the camera is set to the area from the inflow portion near to the center of the crossing, and improves vehicle extraction accuracy.

Figure 6:
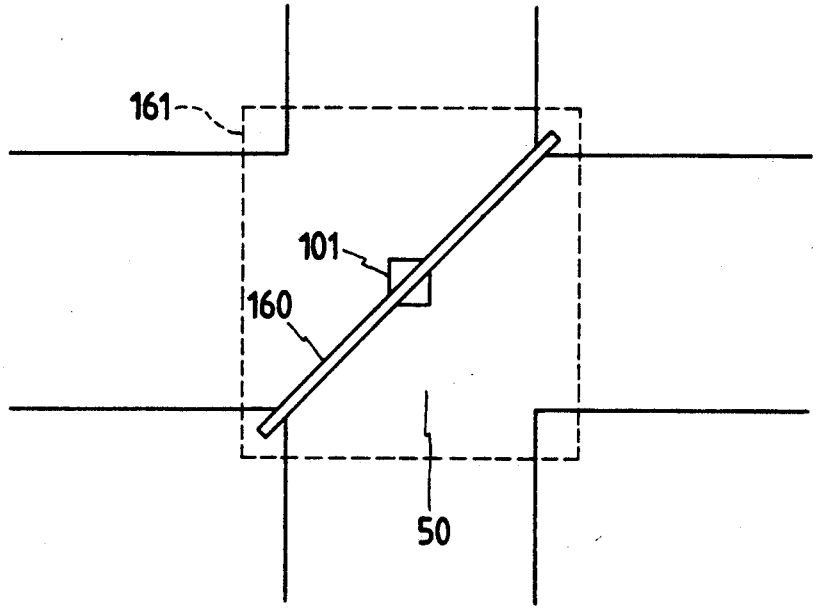
FIG. 6 is a method showing a setting method of a camera in accordance with one embodiment of the present invention.
Figure 7:
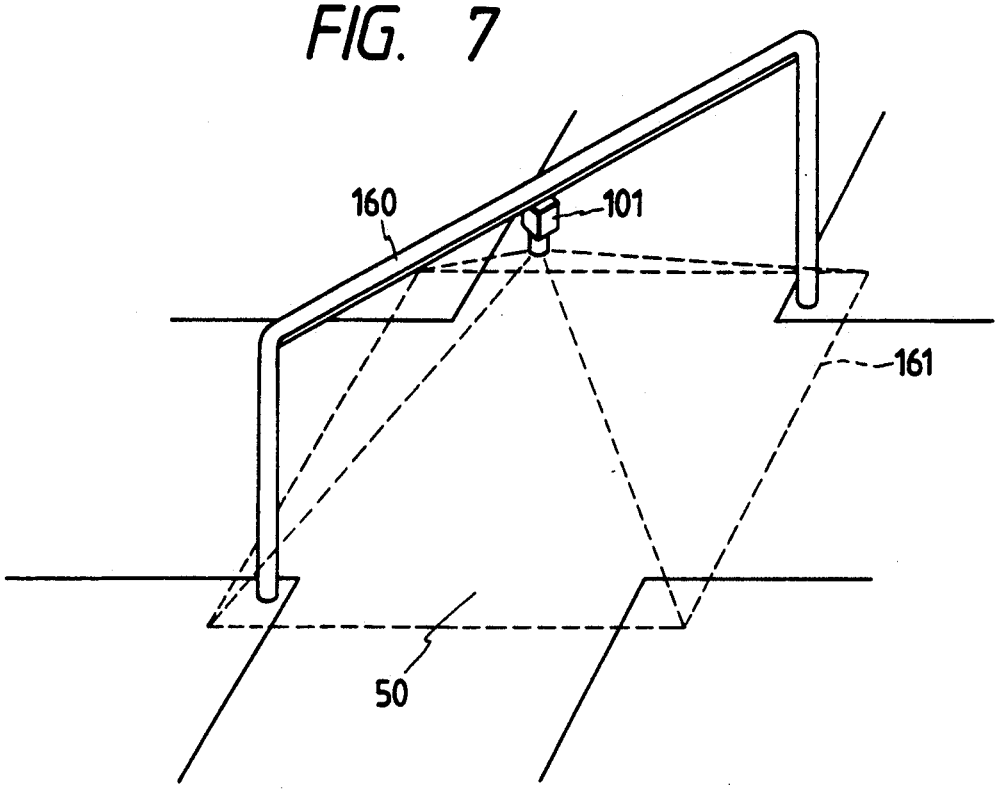
FIG. 7 is a view showing also the setting method of a camera in accordance with one embodiment of the present invention.

Another setting method of the field of the camera is shown in FIGS. 6 and 7. One camera 101 is set above the center of the crossing 50 by a support post 160. Using a wide-angle lens, the camera 101 can cover the crossing as a whole in its field 161. According to this embodiment, the number of cameras can be reduced to one set and the height of the support post for installing the camera can be reduced, as well.

Figure 8:
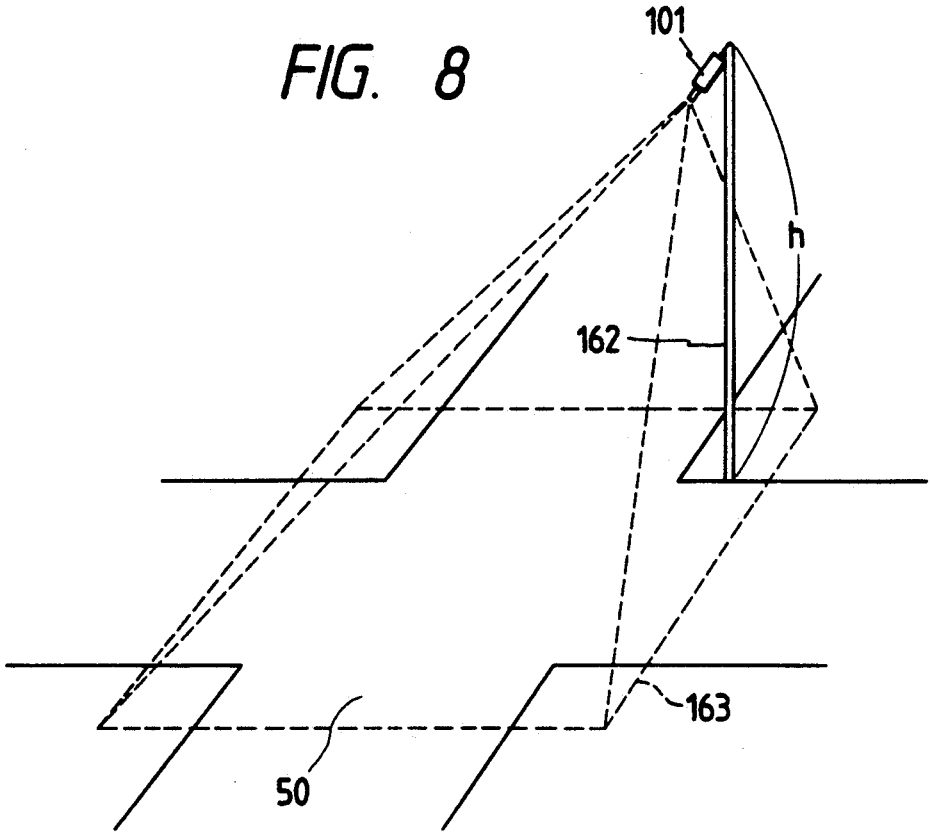
FIG. 8 is a view showing a setting method of a camera in accordance with another embodiment of the present invention.

Still another setting method of the camera is shown in FIG. 8. One camera 101 is set to a height h (e.g. $h \geqq 15$ m) of the support post of the signal of the crossing 50 or of the support post 162 near the signal and obtains the field 163 by use of a wide-angle lens. According to this embodiment, the number of cameras can be reduced to one set and since no support posts that cross the crossing are necessary, the appearance is excellent.

Figure 9:
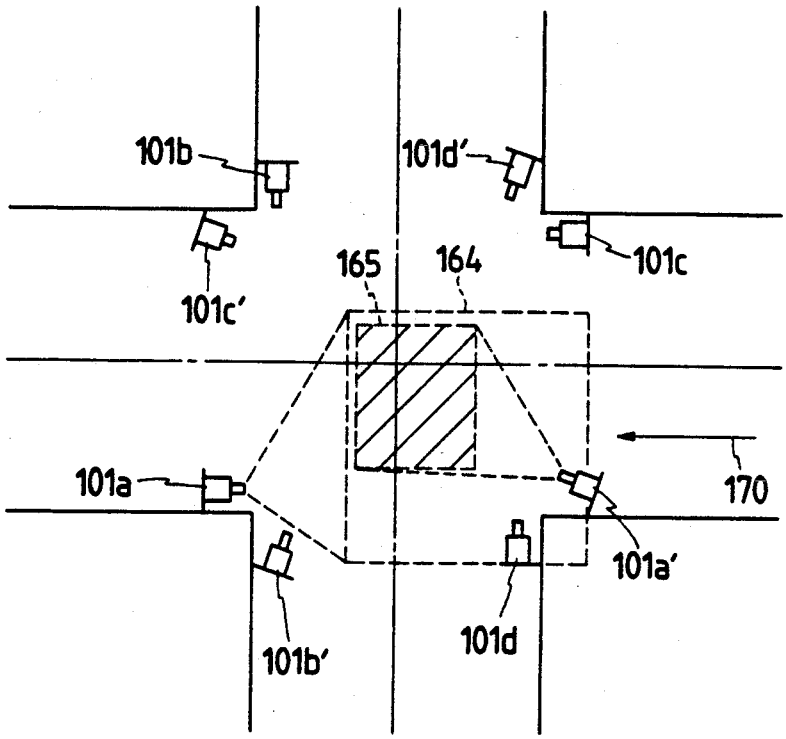
FIG. 9 is a view showing a setting method of another camera in accordance with still another embodiment of the present invention.

Still another setting method of the camera is shown in FIG. 9. This embodiment uses eight cameras in a crossing of four roads (or $2n$ sets of cameras for an n-way crossing or a crossing of n-roads). The field 164 (the area encompassed by an open frame) of the camera 101*a* is set to the area from the inflow portion of the crossing near to its center for the group of vehicles having the flow represented by arrow 170 and the field 165 (the area encompassed by the hatched frame) of an auxiliary camera 101*a'* is set near to the center of the crossing. Similarly, the fields of the pairs of cameras, that is, the cameras 101*b* and 101*b'*, 101*c* and 101*c'* and 101*d* and 101*d'*, are set to the areas extending from the inflow portions of the crossing near to its center and to the opposed center portions, respectively. According to this embodiment, the images of the group of vehicles flowing in one direction can be taken both from the front and back and the overlap of the vehicles inside the fields of the cameras, particularly the overlap of the right turn vehicles by the right turn vehicles opposite to the former, can be avoided, so that extraction accuracy of the vehicles can be improved.

Figure 10:
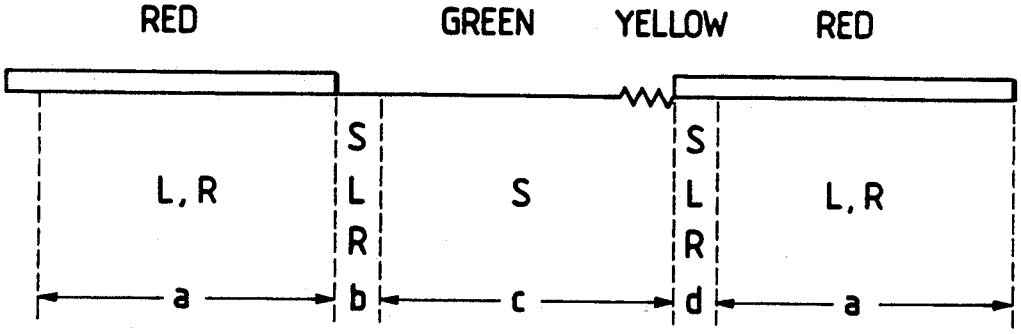
FIG. 10 is an explanatory view useful for explaining an object of measurement in accordance with a time zone which is interlocked with a display signal of a signal.
Figure 11:
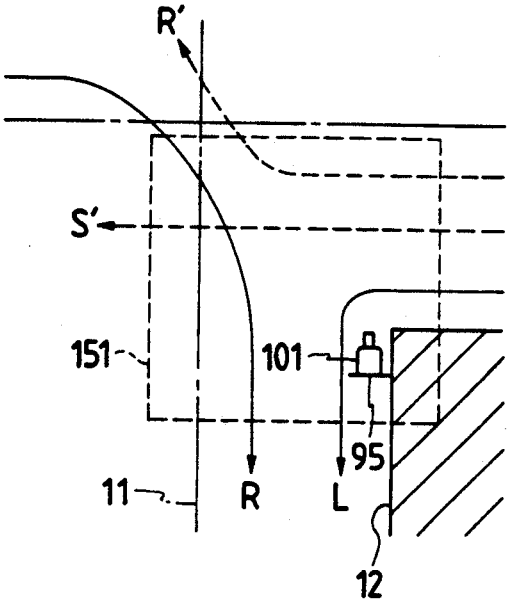
FIG. 11 is a view showing the flow of vehicles in each time zone of FIG. 10.
Figure 12:
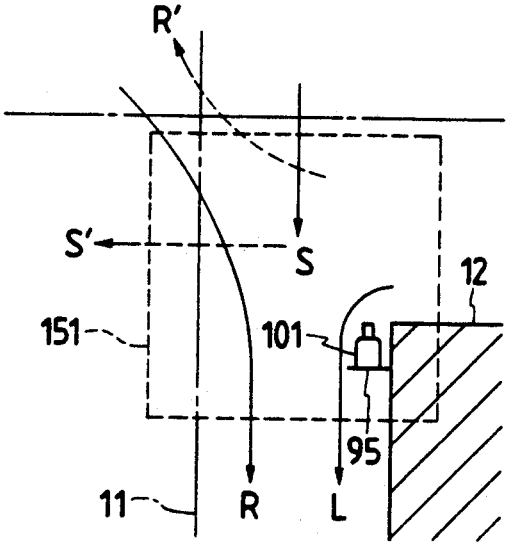
FIG. 12 is a view showing the flow of vehicles in each time zone of FIG. 10.
Figure 13:
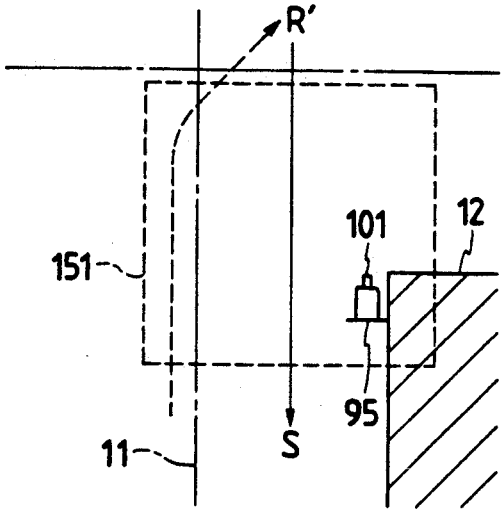
FIG. 13 is a view showing the flow of vehicles in each time zone of FIG. 10.
Figure 14:
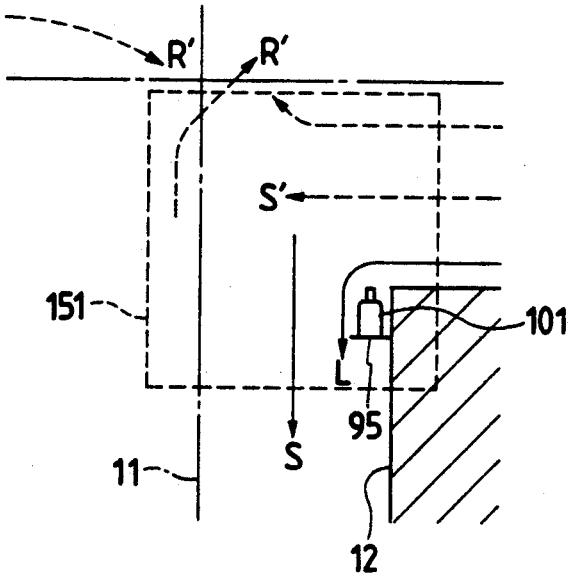
FIG. 14 is a view showing the flow of vehicles in each time zone of FIG. 10.

Next, the interlocking operation between the traffic flow measuring apparatus main body 90 and the signal controller 114 will be explained. The display signals from the controller 114 are shown in FIG. 10. FIGS. 11–14 show the flows of vehicles in each, time zone a–d when the display signal of the signal light 95 changes as shown in FIG. 10 in the case where the camera 101 is disposed above the signal light 95. In the time zone a where the signal light 95 displays the red signal, the left turn vehicles L and the right turn vehicles R are measured. In the time zone b which represents the passage of a certain time from the change of the signal light 95 from red to green, the left turn vehicles L, the straight run vehicle S and the right turn vehicles R shown in FIG. 12 are measured. In the time zone c in which the signal light 95 displays the green and yellow signals, the straight run vehicles S shown in FIG. 11 are measured. In the time zone d which expresses the passage of a certain time from the change of the signal 95 from the yellow signal to the red signal, the left turn vehicles L and the straight run vehicles S shown in FIG. 14 are measured.

In FIGS. 11, 12, 13 and 14 representing the time zones a, b, c and d, the flows of the vehicles (the straight run vehicles S' and right turn vehicles R' represented by arrow of dash line) in the direction straightforward to the camera 101 and to the signal light 95 may be neglected because they are measured by other cameras but if they are measured, the results of measurement by the cameras can be checked mutually.

Incidentally, FIGS. 10 and 11–14 show the basic change of the display of the signals and the flows of vehicles corresponding to such a change. In the case of other different signal display methods such as a signal display method equipped with a right turn display or with a scramble display, too, detection can be made similarly by defining the detection objects (left turn vehicles, straight run vehicles and right turn vehicles) corresponding to the time zone and by preparing a vehicle orbit point table and a vehicle search map (which will be explained later in further detail) corresponding to the time zone.

Figure 15:
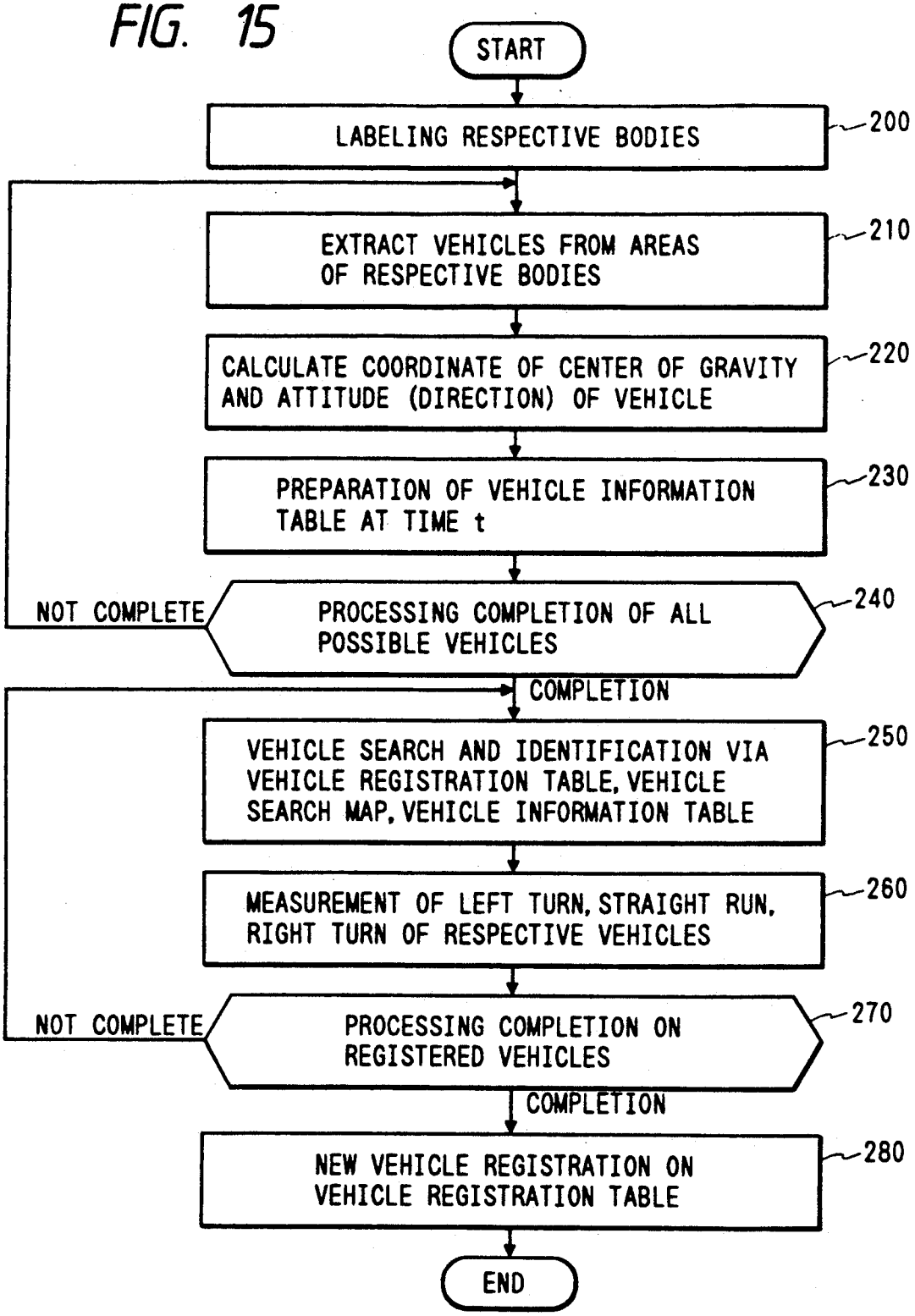
FIG. 15 is a flowchart showing the flow of a traffic flow measuring processing.

Next, the measuring processing of the left turn vehicles, straight run vehicles and right turn vehicles (corresponding to characteristic quantity extraction 30 and measurement 31 in FIG. 30) will be explained briefly. FIG. 15 shows the flow of this processing.

To begin with, the labelling circuit 107 performs a labelling of the object inside the binary image 4 (step 200). After labelling is carried out for each object, it is then determined for each object, whether or not area is within the range expressing the vehicle and the objects inside the range are extracted as the vehicles (step 210). The coordinates of a centroid of the extracted vehicle and its posture (direction) are determined (step 220) and a vehicle data table is prepared (step 230). Whether or not processing is completed for all the possible vehicles is judged on the basis of the number of labels (the number of objects) (step 240) and if it is not complete, the flow returns to step 210 and if it is, the flow proceeds to the next step. Search and identification for tracking the vehicles is carried out by referring to the vehicle registration table 51, the vehicle search map 52 and the vehicle data table 53 (step 250). The points of left turn, straight run and right turn in the vehicle registration table 51 are updated for the identified vehicles by use of the vehicle orbit point table 54. If the vehicles (the vehicles registered already to the vehicle registration table 51) that existed at the time $t_o$ (the time one cycle before the present time t) are out of the field at this time t, the speeds of the vehicles are judged from the period in which they existed in the field and from their moving distances and whether they are left turn vehicles, straight run vehicles or right turn vehicles are judged from the maximum values of the vehicle locus points, and the number of each kind (left turn vehicles, straight run vehicles, right turn vehicles) is updated (step 260). Whether or not the processings of steps 250 and 260 are completed for all the registered vehicles is judged (step 270) and if it is not completed, the flow returns to the step 250 and if it is, the vehicles appearing afresh in the field 151 of the camera are registered to the vehicle registration table 51 (step 280). The processing at the time t is thus completed.

Next, the preparation method of the vehicle data table 53 (corresponding to the step 230) will be explained with reference to FIGS. 16 to 20.

Figure 16:
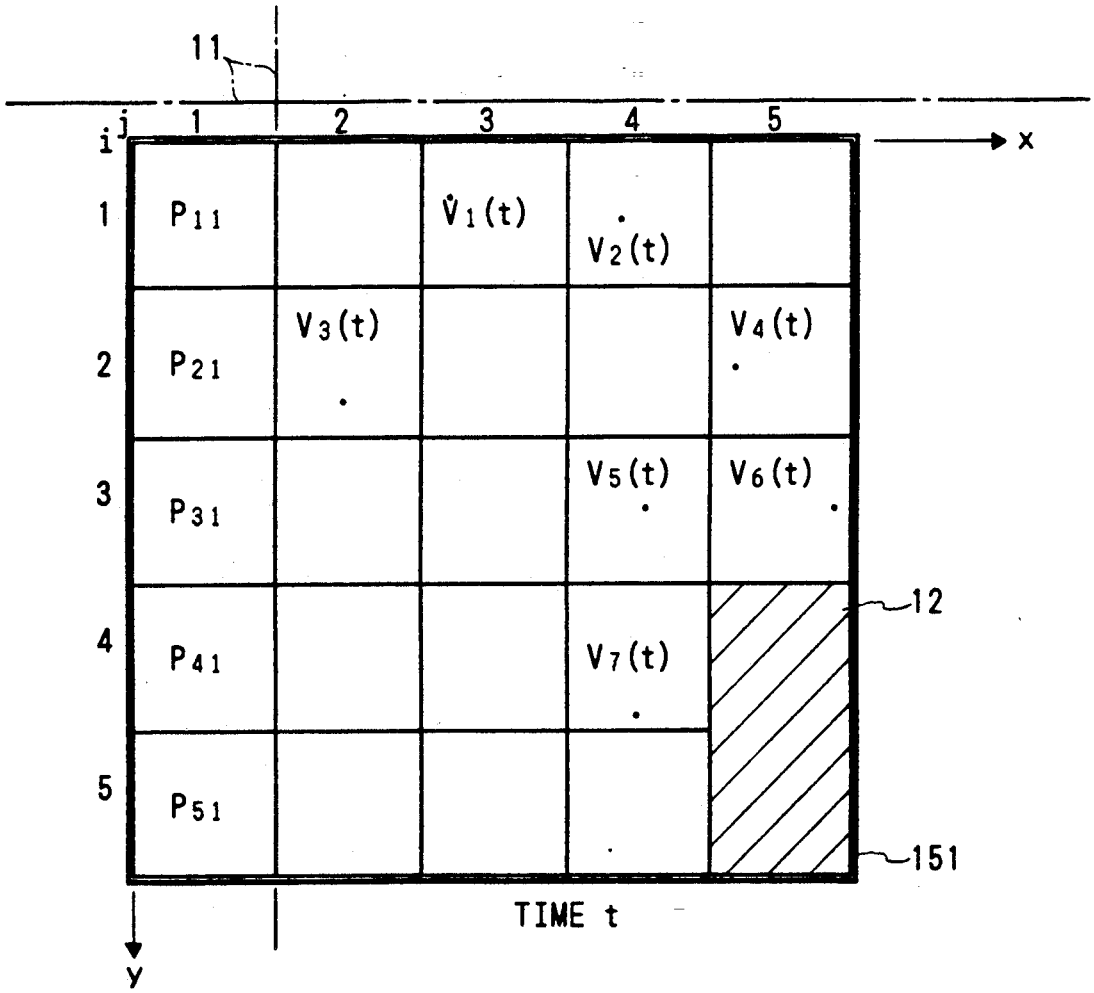
FIG. 16 is a view showing the existing positions of vehicles inside the field of a camera.
Figure 17:
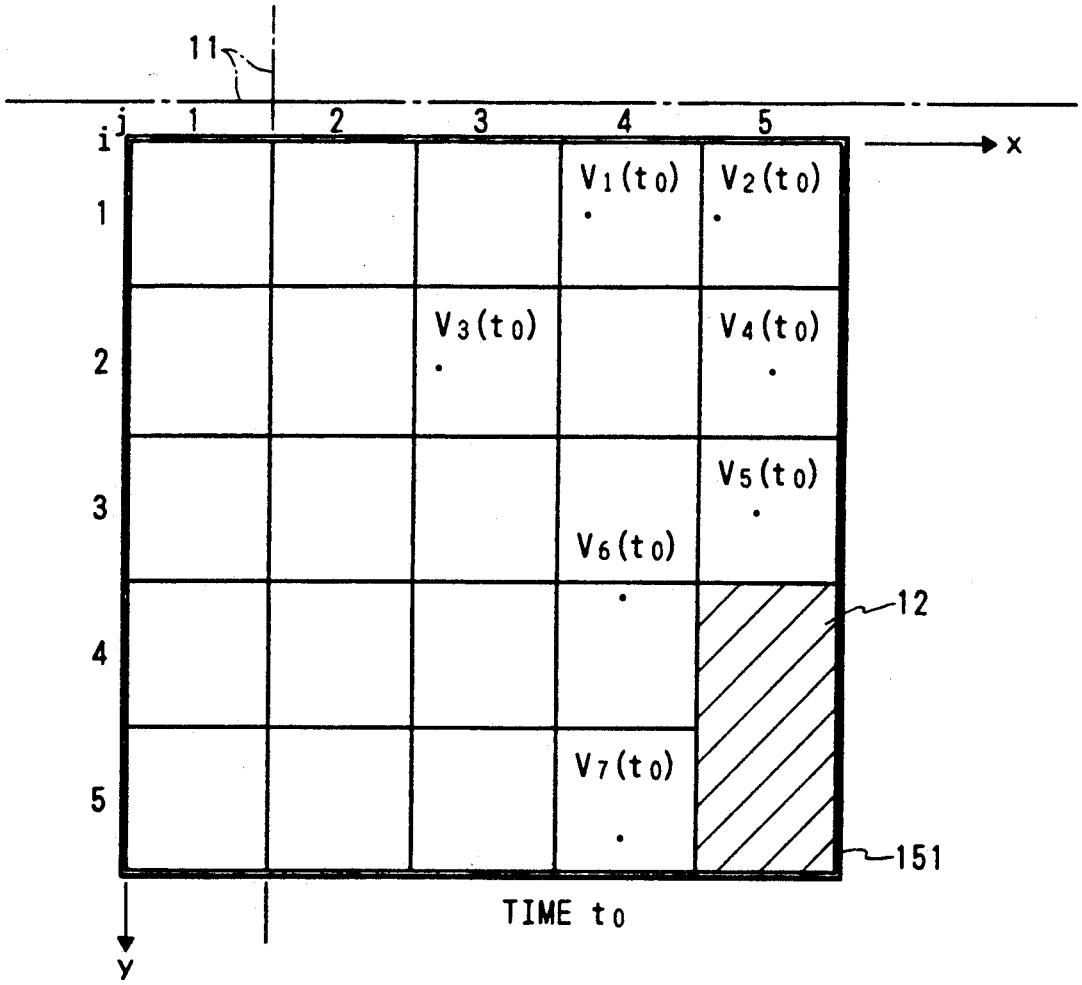
FIG. 17 is a view showing the existing positions of vehicles inside the field of a camera.

FIGS. 16 and 17 show the positions of the vehicles existing inside the camera field 151. FIG. 16 shows the existing positions of the vehicles at the present time t and FIG. 17 shows the positions of the vehicles at the time $t_o$ which is ahead of the time t by one cycle.

Figures 19, 20:
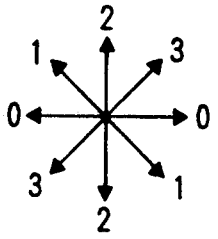
FIG. 19 is an explanatory view useful for explaining a vehicle data table in accordance with still another embodiment of the present invention.
FIG. 20 is a view useful for explaining the postures of vehicles.
Figure 25:
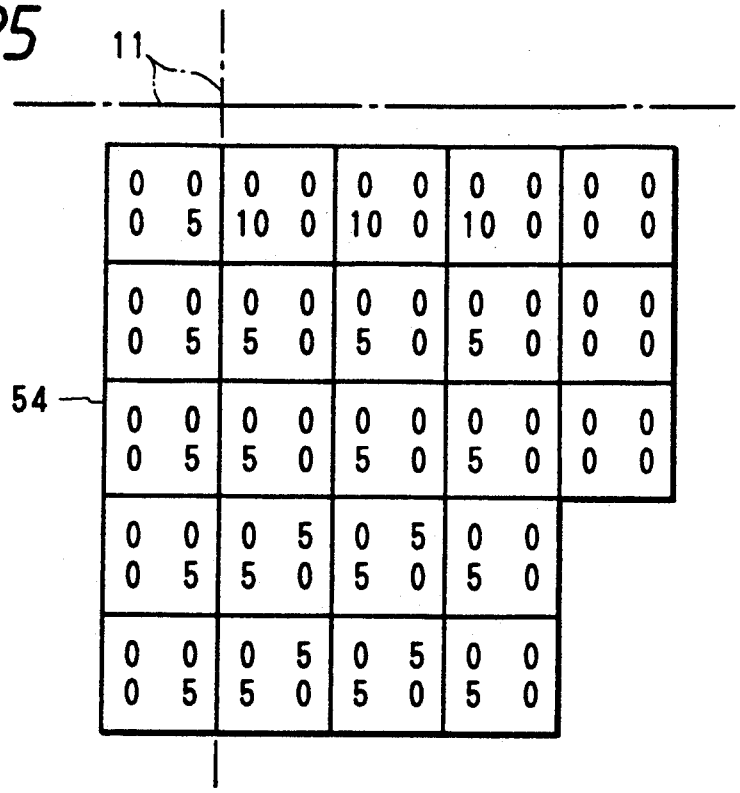
FIG. 25 is an explanatory view useful for explaining the vehicle orbit point table.
Figure 26:
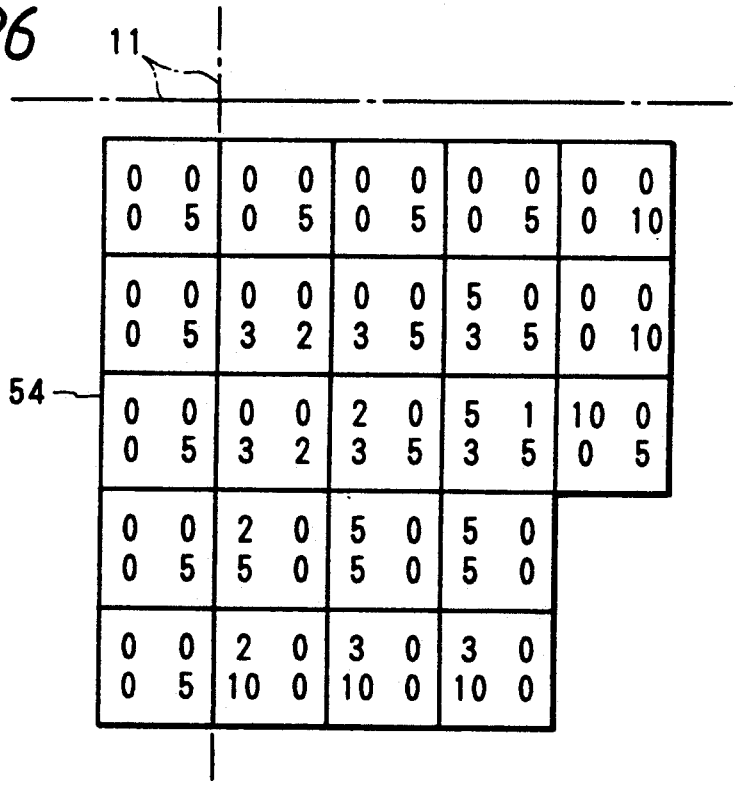
FIG. 26 is an explanatory view useful for explaining the vehicle orbit point table.

In order to facilitate subsequent processings, the block coordinates Pig ($1 \leqq i \leqq m$, $1 \leqq g \leqq n$) are defined by dividing equally the camera field 151 into m segments in a Y direction and n segments in an X direction or in other words, into $m \times n$. Both m and n may be arbitrary values but generally, they are preferably about (the number of lanes)+2 of one side of the road. (In the case of FIGS. 16 and 17, $m=n=5$ for three lanes on one side of the road.) Symbols $V_1(t)$–$V_7(t)$ in the drawings represent the existing positions (coordinates of a centroid) of the vehicles, respectively. When the vehicles exist as shown in FIG. 16, the vehicle data table 53 is prepared as shown in FIG. 19. FIG. 18 shows a vehicle data index table 55, which comprises pointers for the vehicle data table 53 representing the existing vehicles on the block coordinates Pig FIG. 19 shows the vehicle data table 53, which stores x and y coordinates on the image memory (the coordinates of the image memory use the upper left corner as the origin and have the x axis extending in the rightward direction and the y axis extending in the lower direction) and the postures (directions) of the vehicles as the data for each vehicle Vk(t). FIG. 20 represents the postures (directions) of the vehicles by 0–3. Incidentally, the postures of the vehicles can be expressed more finely such as 0–5 (by 30°) and can be expressed still more finely but this embodiment explains the case of the angle of 0–3. The drawing shows the case where the size of the image memory (the size of the camera field) is set to $256 \times 256$.

Next, the method of searching and identifying the vehicles (corresponding to the step 250) for tracking the individual vehicles will be explained.

FIGS. 21 and 22 show the vehicle registration table 51 storing the vehicles to be tracked. FIG. 21 shows the content before updating at the time t. In FIG. 21, an effective flag represents whether or not a series of data of the vehicles are effective. The term "start of existence" means the first appearance of the vehicle inside the camera field 151 and represents the time of the appearance and the block coordinates in which the vehicle appears. On the other hand, the term "present state" means a series of data of the vehicle at the time ($t_o$) which is ahead of the present time by one cycle, and represents the block coordinates on which the vehicle exists at that time ($t_o$), the x-y coordinates on the image memory and furthermore, the moving distance of the vehicle inside the camera field and the accumulation of the orbit points of the block through which the vehicle passes.

Here, the term "orbit point" means the degree of possibility that the vehicle becomes a left turn vehicle L, a straight run vehicle S, a right turn vehicle R or other vehicle (the vehicles exhibiting the movement represented by arrow of dash line in FIGS. 11–14) when the vehicle exists in each block. The greater the numeric value, the greater this possibility. FIGS. 23–26 show the vehicle locus point table 54. These drawings correspond to the time zones a–d shown in FIG. 10.

Figures 27A, 27B:
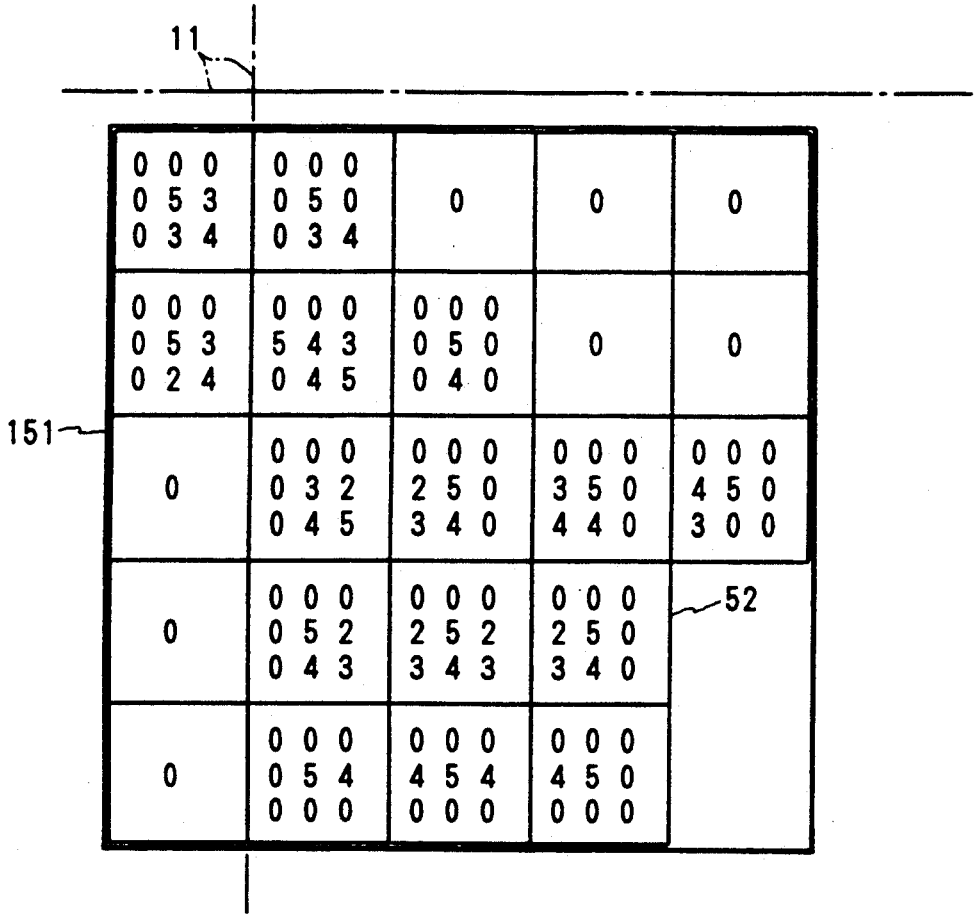
FIGS. 27A and 27B are explanatory views useful for explaining a vehicle search map.

Now, the search and identification method of a vehicle for tracking will be explained for the case of a vehicle $V_5(t_o)$ by way of example. Since the present position of the vehicle (the position at the time $t_o$ one cycle before) is $P_{35}$, the same position having the maximum value of the value of the map 52 in the block $P_{35}$ (upper left: 0, up: 0, upper right: 0, left: 4, same position: 5, right: 0, lower left: 3, down: 0, lower right: 0), that is, $P_{35}$, is first searched by referring to the vehicle search map 52 shown in FIG. 27. It can be understood from the block coordinates $P_{35}$ of the vehicle data index table 55 that the vehicle $V_6(t)$ exists. When the x-y coordinates of $V_5(t_0)$ and $V_6(t)$ on the image memory are compared with one another, it can be understood that their y coordinates are 125 and the same but their x coordinates are greater by 25 for $V_6(t)$. This means that the vehicle moves to the right and is not suitable. Accordingly, $V_6(t)$ is judged as not existing. Since no other vehicle exists in the $P_{35}$ block, the block $P_{34}$ having a next great value in the map value is processed similarly so as to identify $V_5(t)$. Then, the block coordinates $P_{34}$, x-y coordinates 185, 125 of the vehicle $V_5(t)$ are written from the vehicle data table 53 into the vehicle registration table 51. The moving distance from $V_5(t_o)$ to $V_5(t)$ ($225-185=40$) is calculated and is added to the present value ($=0$) and is written into this position. Furthermore, the orbit points (left turn: 5, right turn: 1, straight run: 2, others: 5) of the block coordinates $P_{34}$ are referred to and are added to the present value (left turn: 5, right turn: 0, straight run: 0, others: 10) and the result (left turn: 10, right turn: 1, straight run: 2, others: 15) are written into this position.

Due to the series of processings described above, the present state is updated as shown in FIG. 22 ($V_7(t)$, $V_5(t)$). Next, the measuring method of each of the left turn, straight run and right turn vehicles) (corresponding to the step 260) will be explained. The search is made similarly for the search range $P_{54}$ (first priority) and $P_{53}$ (second priority) of the block coordinates $P_{54}$ in order named and it can be understood from the vehicle data index table 55 that the corresponding vehicle does not exist in the field of the camera. Therefore, this vehicle $V_7(t_o)$ is judged as having moved outside the field 151 of the camera at this time t, and the moving distance (=175) of this vehicle and the time $\Delta t = t_0 - t_{-3}$ are determined by referring to the vehicle registration table 51 before updating. From this is determined the speed of this vehicle. Furthermore, the orbit point (left turn: 30, right turn: 7, straight run: 7, others: 15) and the block moving distance ($\Delta i$; $\Delta j$) ($\Delta i = 3-5 = -2$, $\Delta j = 5-4$ are obtained by comparing i, j of $P_{35}$ and $P_{54}$) are determined. Next, a value corresponding to the absolute value x a (a: natural number such as 3) of the block moving distance is added to the locus point of the table 51 of each orbit point of right turn vehicle when i is positive, left turn vehicle when i is negative, straight run vehicle when j is positive and other vehicle when j is negative, and the sum is used as the final orbit point (the final point of $V_7(t_o)$ is left turn: $30+2\times3=36$, right turn: 7, straight run: $7+1\times3=10$, other: 15). The locus of the vehicle that takes the maximum value of this final point is regarded as the kind of the locus of this vehicle. The vehicle $V_7(t_o)$ is found to be the left turn vehicle, the number of left turn vehicles is updated by incrementing by 1 and the mean speed of the left turn vehicle group is determined from the speed of this vehicle. Finally, the effective flag is OFF in order to delete $V_7(t_o)$ from the vehicle registration table 51.

Next, the registration method of new vehicles to the vehicle registration table (corresponding to the step 280) will be explained.

In the time zone as shown in FIG. 10, judgement is made as to the left half of the block coordinates $P_{11}$, $P_{12}$ and as to whether or not the vehicle appearing for the first time in $P_{21}$, $P_{35}$ is a new vehicle in consideration of the posture of the vehicle (the lower left quarter of $P_{11}$, $P_{12}$, 1 or 2 for the posture of $P_{21}$ and the posture 0 for $P_{35}$). The vehicle $V_6(t)$ existing at $P_{35}$ is known as the new vehicle from the vehicle data index table 55 and from the vehicle data table 53 corresponding to FIG. 16 and this data is added afresh to the vehicle registration table 51 and the effective flag is ON (see FIG. 22).

The above explains the method of measuring the numbers of the left turn vehicles, straight run vehicles, right turn vehicles and the mean speed by tracking the vehicles. In the explanation given above, the flow of vehicles represented by an arrow of dash line in FIG. 11 is not measured but the flow of the vehicles represented by an arrow of the dash line can be made by changing the values of the vehicle search map 52 shown in FIG. 27 and by checking also whether or not the vehicle appearing for the first time inside the camera field exists not only in the lower left half of the blocks $P_{11}$, $P_{12}$ and $P_{21}$, $P_{35}$ but also in $P_{15}$, $P_{25}$ in the registration of the new vehicle to the vehicle registration table 51 in FIG. 15. Accordingly, measurement can be made with a higher level of accuracy by comparing the data with the data of the straight run vehicle measured by the left-hand camera and with the data of the right turn vehicle measured by the upper left camera.

According to this embodiment, accuracy of the traffic flow measurement can be improved by preparing the vehicle search map and the vehicle locus point table in accordance with the change of the display signal light of the signal.

Furthermore, traffic flow measurement can be made in accordance with an arbitrary camera field (e.g. the crossing as a whole, outflow portion of the crossing, etc) by preparing the vehicle search map and the vehicle locus point table in response to the camera field.

The methods of measuring the numbers of left turn vehicles, right turn vehicles and straight run vehicles and of measuring the speed include also a method which stores the block coordinates for each time and for each vehicle that appears afresh in the camera field until it goes out from the field and tracks the stored block coordinates when the vehicle goes out of the field to identify the left turn vehicles, straight run vehicles and right turn vehicles without using the vehicle locus point table described above. The vehicle locus point table and the vehicle search map described above can be prepared by learning, too. In other words, the block coordinates through which a vehicle passes are stored sequentially on an on-line basis for each vehicle and at the point of time when the kind of the locus of this vehicle (left turn, right turn, straight run, etc) is determined, the corresponding point of each block (i.e. left turn for the left turn vehicle, straight run for the straight run vehicle, etc) through which the vehicle passes is updated by +1 in the vehicle locus point table for learning. A vehicle search map can be prepared by determining the moving direction of one particular block to a next block by referring to the stored block coordinates line of the vehicle search map described above, updating +1 of the point in the corresponding direction of the vehicle search map for learning (upper left, up, upper right, left, same position, right, lower left, down, lower right) and executing sequentially this processing for each block of the block coordinates line. In this manner, accuracy of the vehicle locus point table and vehicle search map can be improved.

Next, a method of measuring the traffic flow by use of data from a single road traffic flow measuring apparatus 115 such as a vehicle sensor for measuring simply the inflow/outflow traffic quantity of each road and a method of checking any abnormality of the traffic flow measuring apparatus 90 (inclusive of the camera 101) when extreme data are provided, by use of the data described above in accordance with another embodiment of the present invention will be explained. To explain more generally, the inflow/outflow quantity (the numbers of inflow/outflow vehicles) Nki, Nko ($k=1, 2, \ldots, m$) of each road k of an m-way crossing and the number of vehicles in each moving direction Nkj ($k=1, 2, \ldots, m$; $j=1, 2, \ldots, m-1$) necessary for solving equation, though different depending on the number m of crossing roads; are measured and equation of the inflow/outflow relationship of vehicles between the number of inflow/outflow vehicles Nki of each road k and the number of vehicles in each moving direction Nko is solved so as to obtain the number of vehicles Nkj in each moving direction in each of the remaining roads k for which measurement is not made. Here, the number of inflow/outflow vehicles Nki, Nko in each road k is measured by a conventional single road traffic flow measuring apparatus 115 such as a vehicle sensor; or the like. Accordingly, if the number of crossing roads at a certain crossing is m (m is an integer of 3 more), the number of variables (the number of vehicles Nkj in each moving direction to be determined) is $m(m-1)$ and the number of simultaneous equations (the number of inflow/outflow vehicles in each road) is 2 m, n sets of numbers of vehicles Nkj in each moving direction must be measured in order to obtain the number of vehicles Nkj in each moving direction of each road k:

$$n = m(m-1) - 2m + 1 = m^2 - 3m + 1 \quad (1)$$

Incidentally, one, five and eleven numbers of vehicles Nkj in the moving direction must be measured in ordinary 3-way crossing, 4-way crossing and 5-way crossing, respectively. Furthermore, the Kirchhoff's law in the theory of electric circuitry, i.e. "the sum of the numbers of vehicles flowing from each road k into the crossing is equal to the sum of numbers of vehicles flowing out from the crossing to each road k", is established at the crossing when the simultaneous equation described above is solved. Therefore, if the variable which is the same as the number of the simultaneous equations is to be determined, the coefficient matrix formula of the coefficient matrix A of the simultaneous equation becomes zero and a solution cannot be obtained. Therefore, one more measurement value becomes necessary. This is the meaning of +1 of the third item of the formula (1). When the number of vehicles Nkj in the moving direction to be measured (one in the 3-way crossing, five in the 4-way crossing and eleven in the 5-way crossing) is selected, selection must be made carefully so as not to decrease the number of the simultaneous equations that can be established.

The equations relative to the incoming traffic flows for each cycle of the signal at an m-way crossing can be used to calculate both ($m^2-3+1$) independent values representing the numbers of vehicles in individual directions and any (2−1) values representing the numbers of vehicles in the individual directions. That is, it is possible to reduce by one the number of positions where the device for measuring uninterrupted traffic flows is to be placed. Hereinafter, explanation will be given about the case of the 4-way crossing (m=4) by way of example.

Figure 28:
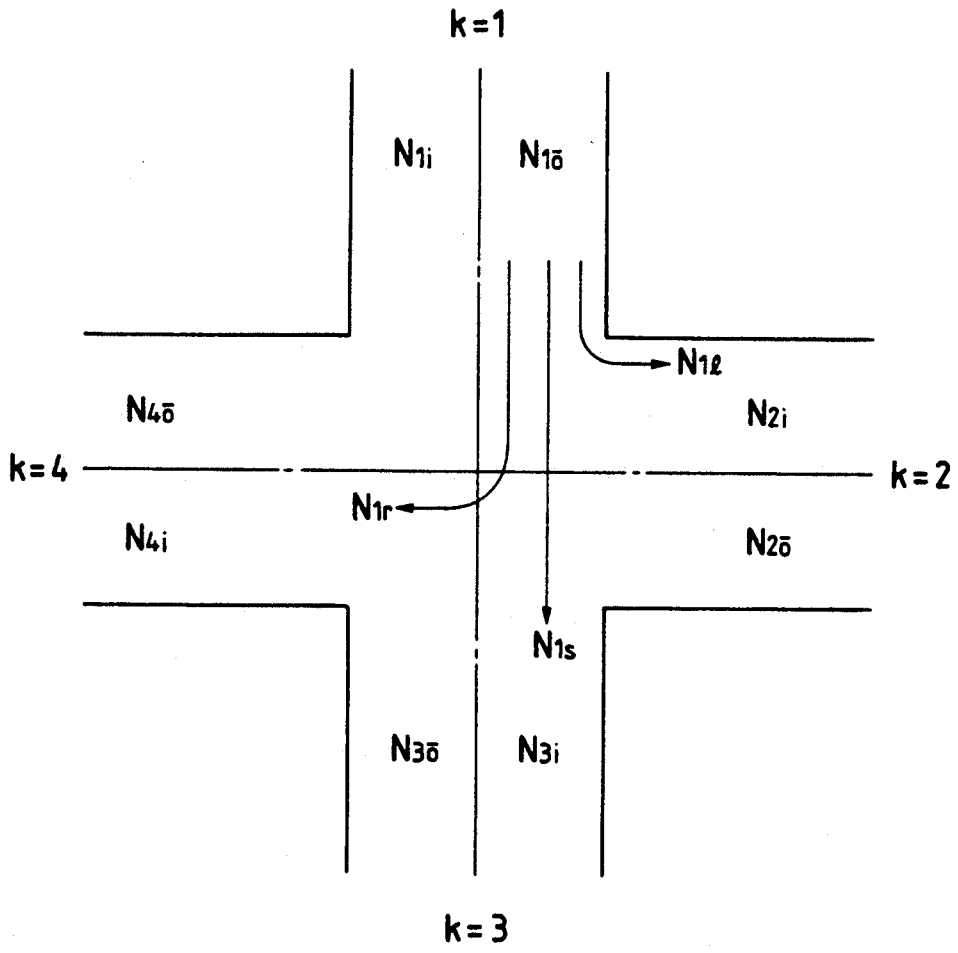
FIG. 28 is a view showing each traffic lane and the flow rate at a crossing.

FIG. 28 shows the flows of vehicles at the 4-way crossing and the numbers of vehicles to be detected. In this drawing, k assumes the values of 1–4. Here, the numbers of vehicles measured within a certain period of time are defined as follows, respectively:

Nki: number of inflowing vehicles into k road
Nko: number of outflowing vehicles from k road
Nkl: number of left turn vehicles from k road
Nks: number of straight run vehicles from k road
Nkr: number of right turn vehicles from k road.

Here, the number of vehicles Nkj (j=1, 2, 3) in each moving direction of each road is defined as Nkl, Nks and Nkr. The values Nki and Nko are the values inputted from the single road traffic flow measuring apparatus 115 such as the vehicle sensor. Using any seven of these eight measurement values (k=1, 2, 3, 4) and five independent measurement values measured by the measuring apparatus 90 by use of the camera 101 (the number of right turn or straight run vehicles Nkr, Nks as the sum of the four left turn vehicles plus 1, or the number of left turn or straight run vehicles Nkl, Nks (k=1, 2, 3, 4) as the sum of the four right turn vehicles Nkr plus 1 in order to make effective the eight equations of the formula (2) below), or in other words, thirteen in all, of the known values, eight simultaneous equations of the number 6 are solved, so that seven remaining numbers of vehicles in each moving direction among the twelve numbers of vehicles in each moving direction Nk, Nks and Nkr (k=1, 2, 3, 4) are determined as unmeasured values from the apparatus 90.

$$Nko = Nkl + Nks + Nkr \quad (k = 1, 2, 3, 4) \quad (2)$$
$$N_{1i} = N_{4l} + N_{3s} + N_{2r}$$
$$N_{2i} = N_{1l} + N_{4s} + N_{3r}$$
$$N_{3i} = N_{2l} + N_{1s} + N_{4r}$$
$$N_{4i} = N_{3l} + N_{2s} + N_{1r}$$

Here, a time lag occurs between the measurement value obtained by the single road traffic flow measuring apparatus 115 such as the vehicle sensor and the measurement value obtained by the camera 101 due to the position of installation of the apparatus 115 (the distance from the crossing). Therefore, any abnormality of the measuring apparatus 90 inclusive of the camera 101 can be checked by comparing the value obtained from equation (2) above with the measurement value obtained by use of the camera 101 and the value itself obtained from equation (2) can be used as the measurement value.

Figure 33:
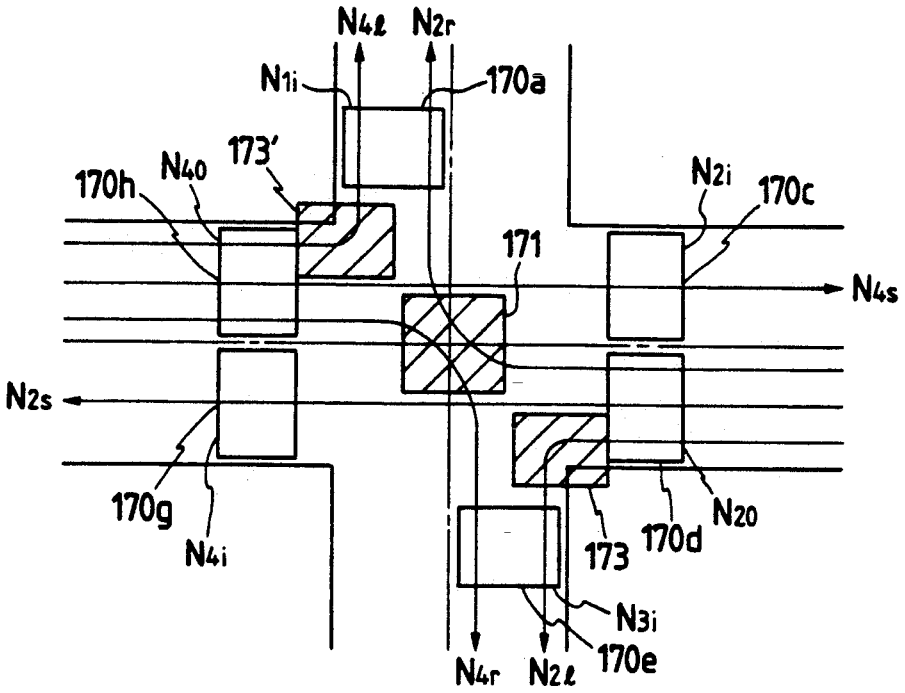
FIG. 33 is a view showing still another embodiment of the present invention.
Figure 34:
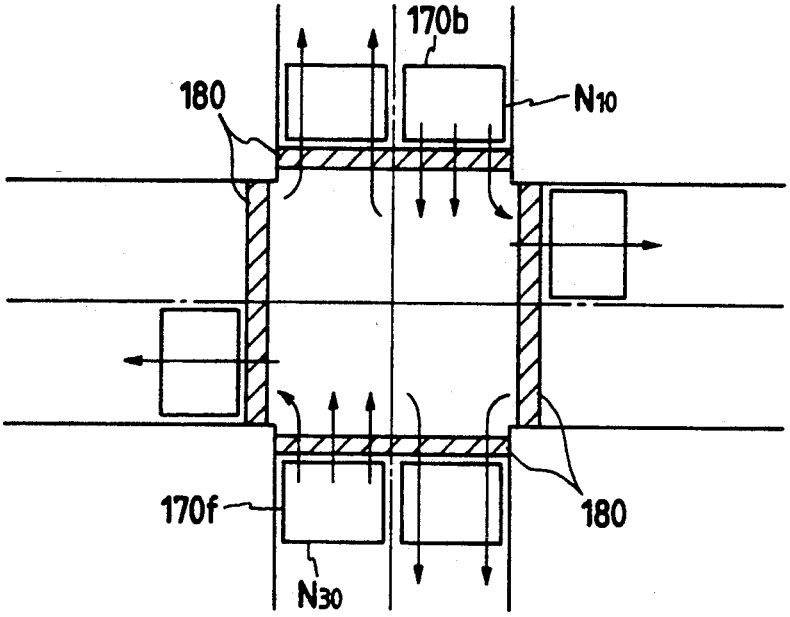
FIG. 34 is a view showing still another embodiment of the present invention.
Figure 35:
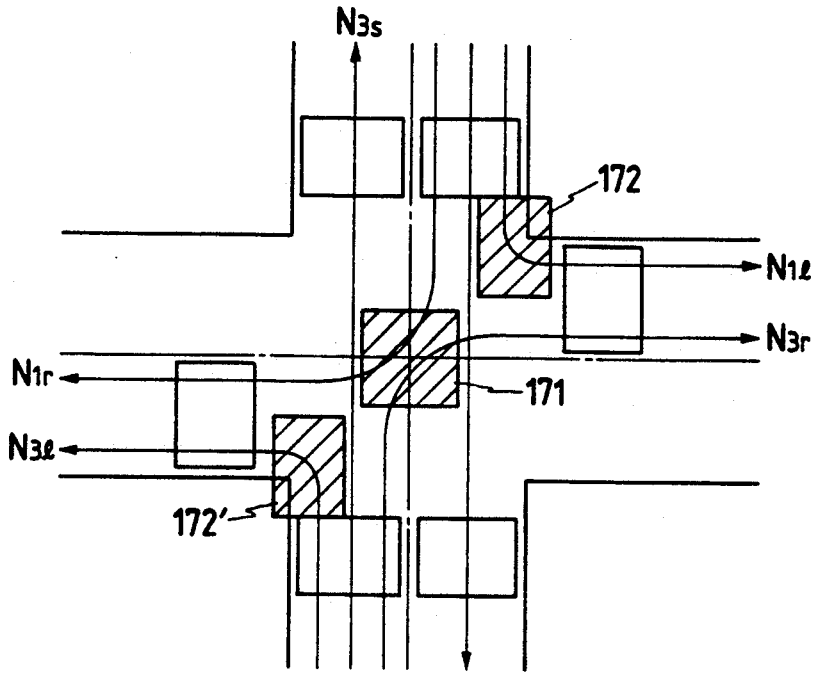
FIG. 35 is a view showing still another embodiment of the present invention.
Figure 36:
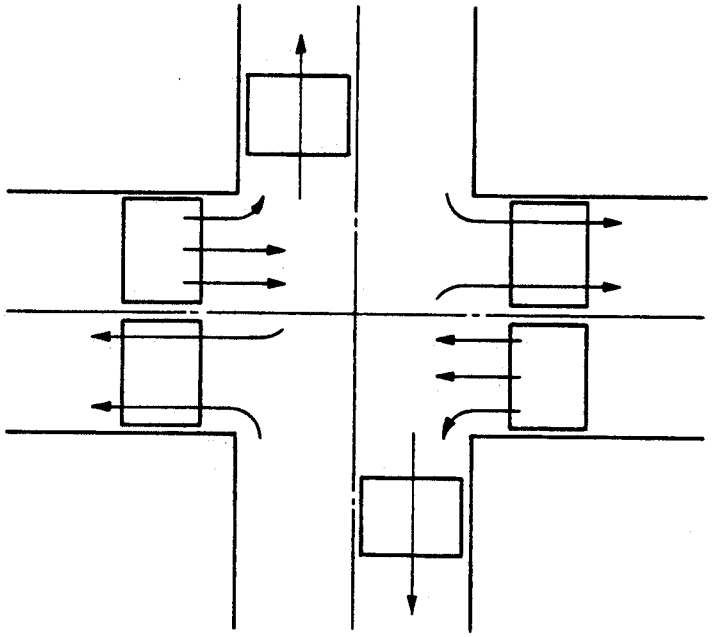
FIG. 36 is a view showing still another embodiment of the present invention.

Next, still another embodiment of the present invention will be explained with reference to FIGS. 33 . to 36. This embodiment discloses a method of measuring the numbers of left turn vehicles, right turn vehicles and straight run vehicles of each lane at a 4-way crossing by dividing the cases into the case of the red signal and the case of the green signal by utilizing the display signal of the signal 95. Incidentally, it is possible to cope with other n-way crossings on the basis of the same concept. FIGS. 33 to 36 correspond to the time zones a–d of the display signal of the signal 95 shown in FIG. 10. In FIGS. 33 to 36, when the number of inflowing vehicles Nki in the road k (k=1, 2, 3, 4), the number of outflowing vehicles Nko and the number of right turn vehicles $N_{2r}$ or $N_{4r}$ or the number of left turn vehicles $N_{2l}$ or $N_{4l}$ (in the case of FIGS. 33 and 34) and the number of right turn vehicles $N_{1r}$ or $N_{3r}$ or the number of left turn vehicles $N_{1l}$ or $N_{3l}$ (in the case of FIGS. 35 and 36) are measured, the number of the left turn vehicles Nkl from the remaining k roads, the number of right turn vehicles Nkr and the number of straight run vehicles Nks (k=1, 2, 3, 4) can be obtained by calculation from formula (3) and later-appearing formula (4). It is to be noted carefully that a certain time lag exists before the outflowing vehicles from a certain road k are calculated as the inflowing vehicles into another road k'. In FIGS. 33 to 36, therefore, the time zones a–d are associated with one another. For example, the inflow quantity into a certain road in the time zone a is affected by the outflow quantity from a certain road in the previous time zone d and similarly, the outflow quantity from a certain road in the same time zone a affects the inflow quantity to another certain road in the next time zone b. When they are taken into consideration, the number of left turn vehicles Nkl, the number of straight run vehicles Nks and the number of right turn vehicles Nkr (the direction of south-north is the red signal at k=2, 4 and the direction of east-west is the green signal, the road to the east is indicated at k=2 and the road to the west is indicated at k=4) in a certain road k in the time zone a are related with the outflow quantity in the previous time zone d, with the outflow quantity in the present time zone a, with the inflow quantity in the present time zone a and with the inflow quantity in the next time zone b. To explain more definitely, the inflow quantity into a certain road k with the time zone a being the center is expressed as follows as the sum of the inflow quantity in the present time zone a and the inflow quantity in the next time zone b:

$$N_{ki}^{A}=N_{ki}^{a}+N_{ki}^{b}$$

The outflow quantity is expressed by the following equation as the sum of the outflow quantity in the previous time zone d and the outflow quantity in the present time zone a:

$$N_{ko}^{A}=M_{ko}^{d}+M_{ko}^{a}$$

Accordingly, the following equation (3) can be established:

$$\begin{aligned} N_{1i}^{A} &= N_{1i}^{a}+N_{1i}^{b}=N_{4i}+N_{2r} \\ N_{2i}^{A} &= N_{2i}^{a}+N_{2i}^{b}=N_{45} \\ N_{2o}^{A} &= N_{2o}^{a}+N_{2o}^{b}=N_{2i}+N_{2s}+N_{2r} \\ N_{3i}^{A} &+ N_{3i}^{a}+N_{3i}^{b}=N_{2i}+N_{4r} \\ N_{4i}^{A} &= N_{4i}^{a}+N_{4i}^{b}+N_{2s} \\ N_{4o}^{A} &= N_{4o}^{a}+N_{4o}^{b}=N_{4i}+N_{4s}+N_{4r} \end{aligned} \tag{3}$$

The inflow quantity and outflow quantity into and from each road k with the time zone c being the center can be likewise expressed as follows:

$$\begin{aligned} N_{1i}^{C} &= N_{1i}^{c}+N_{1i}^{d}=N_{3s} \\ N_{1o}^{C} &= N_{1o}^{c}=N_{1o}^{d}=N_{1i}+N_{1s}+N_{1r} \\ N_{2i}^{C} &= N_{2i}^{c}+N_{2i}^{d}=N_{1i}+N_{3r} \\ N_{3i}^{C} &= N_{3i}^{c}+N_{3i}^{d}=N_{1s} \\ N_{3o}^{C} &= N_{3o}^{c}+N_{3o}^{d}=N_{3i}+N_{3s}+N_{3r} \\ N_{4i}^{C} &= N_{4i}^{c}+N_{4i}^{d}=N_{3i}+N_{1r} \end{aligned} \tag{4}$$

In the equation (3), the left side is the measurement value. In the right side, any one of the right turn vehicles $N_2r$ of the road 2, the left turn vehicles $N_2l$, the right turn vehicle $N_4r$ of the road 4 and left turn vehicles $N_4l$ is the measurement value and the rest are the values which are to be determined by variables. Similarly, the left side in the equation (4) is the measurement value and in the right side, any one of the right turn vehicles $N_1r$ of the road 1, left turn vehicles $N_1l$, the right turn vehicles $N_3{}^tr$ of the road 3 and left turn vehicles $N_3l$ is the measurement value and the rest are the values which are to be determined by variables. In the sets (3) and (4) of equations, one value appears in two equations on their right side. Therefore, one of them can be eliminated, and the value on its left side need not be measured. Consequently, five variables are determined from five equations in each set of equations. Here, the number of inflow vehicles into the road k in the time zone t is set to $N_{ki}$ and the number of outflow vehicles from the road k in the time zone t is set to $N_{kt}{}^t$. In the same way as in equation (2), NKl, NKs and Nkr represent the numbers of left turn vehicles, straight run vehicles and right turn vehicles from the road k, respectively. Incidentally, $N_{ki}{}^t$ and $N_{ko}{}^t$ (k=1, 2, 3, 4) can be measured as the number of vehicles passing through the camera fields 170*a*–170*h* by the traffic flow measuring apparatus main body 90 or by the single road traffic flow measuring apparatus 115 such as the vehicle sensor. $N_1r$, $N_2r$, $N_3r$, $N_4r$ and $N_1l$, $N_2l$, $N_3l$, $N_4l$ can be measured as the number of vehicles passing through the camera field 171 and as the number of vehicles passing through the camera fields 172, 173, 172', 173', respectively, or can be measured by use of the apparatus 115. In order to obtain the final measurement result having strictly high accuracy (Nk(; Nks, Nkr: k=1, 2, 3, 4), Nki can be obtained by measuring the number of inflow and outflow vehicles on the entrance side of the camera fields 170*a*, 170*c*, 170*e*, 170*g* and Nko can be obtained by measuring the number of inflow and outflow vehicles on the exist side of the camera fields 170*b*, 170*d*, 170*f*, 170*h*, respectively. The camera fields 170*b*, 170*d*, 170*f*, 170*h* for measuring the outflow quantity Nko (k=1, 2, 3, 4) from the road k are disposed preferably in such a manner as to include the stop line and to exclude naturally the pedestrian crossing 180 and the signal inside the fields. The camera fields 170*a*, 170*c*, 170*e*, 170*g* for measuring the inflow quantity $N_{ki}{}^5$ (k= 1, 2, 3, 4) from the road k are disposed preferably in such a manner as to exclude naturally the pedestrian crossing 180 and the signal inside them. If the pedestrian crossing 180 and the signal exist inside the fields, these areas must be excluded from the processing object areas by mask processing and window processing in image processing. Incidentally, the pedestrian crossing 180 is omitted from FIGS. 33, 35 and 36. Therefore, a further explanation will be supplemented. The calculation in equation (3) is made immediately after the inflow quantity or outflow quantity of each camera field is measured in the time zone b and the calculation in equation (3) is made immediately after the inflow quantity or outflow quantity of each camera field is measured in the time zone d. Accordingly, each number of vehicles, i.e. Nk(, Nks, Nkr (k=1, 2, 3, 4) is determined in every cycle (time zone a–d) of the phase of the traffic signal 95 shown in FIG. 10.

According to this embodiment, the number of left turn vehicles and the number of straight run vehicles of each road can be obtained by merely determining the flow rate (the number of vehicles) at the entrance and exit of each road connected to the crossing and the number of right turn vehicles or the number of left turn vehicles at two positions at the center of the crossing. Accordingly, the traffic flow of each road (number of right turn vehicles and number of straight run vehicles) can be obtained easily by use of the data obtained by the conventional single road traffic flow measuring apparatus such as the vehicle sensor.

What is claimed is:

1. A traffic flow measuring apparatus comprising:

image input means for taking images of scenes near a crossing;

image processing means for executing various image processings for said images taken in said image input means, extracting possible vehicles and providing characteristic quantities of said possible vehicles; and measuring means for determining position data of vehicles based on said characteristic quantities obtained from said image processing means, for tracking said vehicles by use of said position data and for calculating the number of vehicles moving in at least one direction in which vehicles run;

wherein said measuring means includes vehicle identification means for identifying vehicles on the basis of a moving range data table of moving range data of vehicles for each time zone associated with the phase of the signal lights of a traffic signal controller, a table of points in the moving direction of each vehicle and priority of said moving range, and vehicle moving direction determination means for determining the moving direction of a vehicle on the basis of said points in the moving direction.

2. A traffic flow measuring apparatus according to claim 1, wherein said image processing means includes means for calculating at least the area and the coordinates of centroid of said possible vehicles.

3. A traffic flow measuring apparatus according to claim 1, wherein said moving range data table includes a value representing a priority of a search corresponding to an existing position of a vehicle; said moving direction point table includes a value representing a moving direction point corresponding to a position of passage of a vehicle; said identification means includes means for identifying a vehicle on the basis of said priority of said moving range and on the basis of position coordinates data of said vehicle; said vehicle moving direction determination means including first means for accumulating moving points of a position of passage of said vehicle and second means for calculating moving direction points corresponding to a moving distance, wherein the moving direction of a vehicle is determined from the maximum value of the moving direction points obtained from both of said first and second means.

4. A traffic flow measuring apparatus according to claim 1, wherein said measuring means includes means for preparing said moving range data table and said moving direction point table by learning using data obtained at the time of an on-line measurement.

5. A traffic flow measuring apparatus according to claim 1, wherein said measuring means further includes means for calculating the number of vehicles in each vehicle moving direction by use of measurement values of other traffic flow measuring apparatuses.

6. A traffic flow measuring apparatus according to claim 5, wherein said calculating means uses at least the number of inflowing vehicles and the number of outflowing vehicles of each road corresponding to the phase of a signal light of a traffic signal controller as said measurement values of said other traffic flow measuring apparatuses.

7. A traffic flow measuring apparatus according to claim 5, wherein said calculating means uses the values off our time zones of the phase of the signal lights of the traffic signal controller, including a red time zone corresponding to the passage of a time zone a from the start of a red signal, a time zone b occurring after the start of a green signal, a time zone c occupying a time of the green signal after passage of the time zone b from the start of the green signal, and a yellow time zone d, in determining as the numbers of inflowing and outflowing vehicles of each road.

8. A traffic flow measuring apparatus according to claim 1, wherein said measuring means further includes means for calculating a mean vehicle speed in at least one direction among the vehicle speeds for various vehicle moving directions.

9. A traffic flow measuring apparatus according to claim 1, wherein said image input means and said image processing means are constituted in such a manner as to correspond on an n:1 basis, where n is an integer.

10. A traffic flow measuring apparatus according to claim 1, wherein said image input means and said image processing means are constituted in such a manner as to correspond on the 1:1 basis.

11. A traffic flow measuring apparatus according to claim 1, wherein said image input means, said image processing means and said measuring means are constituted in such a manner as to correspond on a 1:1:1 basis.

12. A traffic flow measuring apparatus according to claim 1, wherein said measuring means further includes vehicle tracking means for storing block coordinates before, at, and after, a new vehicle appears inside the field of said image input means for each vehicle, and determining means for determining the moving direction of said vehicle by tracking the block coordinates that have been stored already, when said vehicle comes out from said field.

13. A traffic flow measuring apparatus comprising:

image input means for taking images of scenes near a crossing;

image processing means for executing various image processings for said images taken in said image input means, extracting possible vehicles and providing characteristic quantities of said possible vehicles; and measuring means for determining position data of vehicles based on said characteristic quantities obtained from said image processing means, for tracking said vehicles by use of said position data and for calculating the number of vehicles moving in at least one direction in which vehicles run;

wherein said measuring means includes means for checking for an abnormality of said measuring means by use of measurement values of other traffic flow measuring apparatuses.

14. A traffic flow measuring apparatus comprising:

image input means for taking images of scenes near a crossing;

image processing means for executing various image processings for said images taken in said image input means, extracting information representing possible vehicles and providing characteristic quantities of said possible vehicles; and measuring means for determining position data of vehicles based on said characteristic quantities obtained from said image processing means, for tracking said vehicles by use of said position data and for calculating the number of vehicles moving in at least one direction in which vehicles run;

wherein said measuring means includes first means for measuring $(m^2-3m+1)$ of the number of vehicles in a moving direction at an m-way crossing, second means for determining numbers of inflowing and outflowing vehicles of each of k roads, and third means for calculating the $[(2k-11]\ (2k-1)$ number of vehicles which continue in the moving direction by use of outputs of said first and said second means.

15. A traffic flow measuring and controlling apparatus comprising:

image input means for taking images of scenes near a crossing;

image processing means for executing various image processings for said images taken in said image input means, extracting data representing possible vehicles and providing characteristic quantities of said possible vehicles;

measuring means for determining position data of a vehicle based on said characteristic quantities obtained from said image processing means, for tracking said vehicles by use of said position data and for calculating the number of vehicles moving in at least one direction in which vehicles run; and control means for controlling a signal on the basis of an output of said measuring means;

wherein said measuring means includes vehicle identification means for identifying vehicles on the basis of a moving range data table of moving range data of vehicles for each time zone associated with the phase of the signal lights of a traffic signal controller, a table of points in the moving direction of each vehicle and priority of said moving range, and vehicle moving direction determination means for determining the moving direction of a vehicle on the basis of said points in the moving direction.

16. A traffic flow measuring and controlling apparatus according to claim 15, wherein said image processing means includes means for calculating at least the area and coordinates of a centroid of a possible vehicle.

17. A traffic flow measuring and controlling apparatus according to claim 15, wherein said moving range data table includes a value representing a priority of a search corresponding to an existing position of a vehicle; said moving direction point table includes a value representing a moving direction point corresponding to a position of passage of a vehicle; said identification means includes means for identifying a vehicle on the basis of said priority of said moving range and on the basis of position coordinates data of said vehicle; and said vehicle moving direction determination means including first means for accumulating moving points of a position of passage of said vehicle, second means for calculating moving direction points corresponding to a moving distance and third means for determining the moving direction of a vehicle from the maximum value of the moving direction points obtained from both of said first and second means.

18. A traffic flow measuring and controlling apparatus according to claim 15, wherein said measuring means includes means for preparing said moving range data table and said moving direction point table by learning using data obtained at the time of an on-line measurement.

19. A traffic flow measuring and controlling apparatus according to claim 15, wherein said measuring means further includes means for calculating the number of vehicles in each vehicle moving direction by use of measurement values of other traffic flow measuring apparatuses.

20. A traffic flow measuring and controlling apparatus according to claim 19, wherein said calculating means includes means for determining at least the number of inflowing vehicles and the number of outflowing vehicles of each road corresponding to the phase signal of a traffic controller traffic flow measuring apparatuses.

21. A traffic flow measuring and controlling apparatus according to claim 19, wherein said calculating means uses the values of four time zones of a phase of signal lights of the traffic signal controller, including a red time zone corresponding to the passage of time a from the start of a red signal, a time zone b occurring after the start of a green signal, a time zone c occupying a time of the green signal after passage of the time zone b from the start of the green signal, and a yellow time zone d, in determining the numbers of inflowing and outflowing vehicles of each road.

22. A traffic flow measuring and controlling apparatus according to claim 15, wherein said measuring means further includes means for calculating a mean vehicle speed in at least one direction in which vehicles run.

23. A traffic flow measuring and controlling apparatus according to claim 15, wherein said image input means and said image processing means are constituted in such a manner as to correspond on an n:1 basis, where n is an integer.

24. A traffic flow measuring and controlling apparatus according to claim 15, herein said image input means and said image processing means are constituted in such a manner as to correspond on a 1:1 basis.

25. A traffic flow measuring and controlling apparatus according to claim 15, wherein said image input means, said image processing means and said measuring means are constituted in such a manner as to correspond on a 1:1:1 basis.

26. A traffic flow measuring and controlling apparatus according to claim 15, wherein said control means includes means for performing on-line signal control of a traffic signal light on the basis of a result of statistical processing of a measurement result produced by said measuring means.

27. A traffic flow measuring apparatus according to claim 26, including means for correcting at least one of a plurality of parameters including a cycle, a split and an offset, on an on-line basis, on the basis of the result of said statistical processing.

28. A traffic flow measuring apparatus according to claim 30, including means for determining a traffic condition of at least one of a right turn lane and a left turn preferential lane and a status of a right turn-only signal on an off-line basis on the basis of the result of said statistical processing.

29. An apparatus according to claim 18, for measuring traffic flow near a crossing, wherein image data from a camera whose field is set to a range from the center of said crossing to the vicinity of its outflow portion is used as input data to said measuring apparatus.

30. An apparatus according to claim 9, wherein image data from the camera whose field is set in such a manner as not to cover a traffic signal inside said crossing is used as input data to said measuring means.

31. A traffic flow measuring and controlling apparatus comprising:

image input means for taking images of scenes near a crossing;

image processing means for executing various image processings for said images taken in said image input means, extracting data representing possible vehicles and providing characteristic quantities of said possible vehicles;

measuring means for determining position data of a vehicle based on said characteristic quantities obtained from said image processing means, for tracking said vehicles by use of said position data and for calculating the number of vehicles moving in at least one direction in which vehicles run; and control means for controlling a signal on the basis of an output of said measuring means;

wherein said measuring means includes means for checking for an abnormality of said measuring means by use of measurement values of other traffic flow measuring apparatuses.

32. A traffic flow measuring and controlling apparatus comprising:

image input means for taking images of scenes near a crossing;

image processing means for executing various image processings for said images taken in said image input means, extracting data representing possible vehicles and providing characteristic quantities of said possible vehicles;

measuring means for determining position data of a vehicle based on said characteristic quantities obtained from said image processing means, for tracking said vehicles by use of said position data and for calculating the number of moving vehicles in at least one direction in which vehicles run; and control means for controlling a signal on the basis of an output of said measuring means;

wherein said measuring means includes first means for measuring ($m^2-3m+1$) [of] numbers of vehicles in a moving direction at an m-way crossing, second means for determining the number of inflowing and outflowing vehicles of each of k roads, and third means for calculating the ($2k-1$) number of vehicles which continue in the moving direction by use of outputs of said first and said second means.

33. A traffic flow measuring apparatus comprising:

image input means for taking image of scenes near a m-way crossing;

image processing means for executing various image processings for said images taken in said image input means, extracting possible vehicles and providing characteristic quantities of said possible vehicles; and measuring means for determining position data of vehicles based on said characteristic quantities obtained from said image processing means, for tracking said vehicles by use of said position data and for calculating the number of moving vehicles in at least one direction in which vehicles run;

wherein said measuring means includes means for determining numbers of vehicles running in individual directions and numbers of incoming and outgoing vehicles at the m-way crossing, and means for performing a calculation, using equations relative to volumes of traffic per signal light cycle at an m-way crossing together with ($m^2-3m+1$) independent values representing the numbers of vehicles running in individual directions and ($2m-1$) values representing the numbers of incoming and outgoing vehicles, so as to calculate the ($2m-1$) values representing the numbers of vehicles which continue running in individual directions.

34. A traffic flow measuring apparatus comprising:

image input means for taking images of scenes near a m-way crossing;

image processing means for executing various image processings for said images taken in said image input means, extracting data representing possible vehicles and providing characteristic quantities of said possible vehicles;

measuring means for determining position data of a vehicle based on said characteristic quantities obtained from said image processing means, for tracking said vehicles by use of said position data and for calculating the number of moving vehicles in at least one direction in which vehicles run; and control means for controlling a signal on the basis of an output of said measuring means;

wherein said measuring means includes means for determining numbers of vehicles running in individual directions and numbers of incoming and outgoing vehicles at the m-way crossing, and means for performing a calculation, using equations relative to volumes of traffic per signal light cycle at an m-way crossing together with ($m^2-3m+1$) independent values representing the numbers of vehicles running in individual directions and ($2m-1$) values representing the numbers of incoming and outgoing vehicles, so as to calculate the ($2m-1$) values representing the numbers of vehicles which continue running in individual directions.

35. A traffic flow measuring apparatus comprising:

image input means for taking images of scenes near a 4-way crossing;

image processing means for executing various image processings for said images taken in said image input means, extracting possible vehicles and providing characteristic quantities of said possible vehicles; and measuring means for determining position data of vehicles based on said characteristic quantities obtained from said image processing means, for tracking said vehicles by use of said position data and for calculating the number of moving vehicles in at least one direction in which vehicles run;

wherein said measuring means includes means for determining the numbers of left-turning and right-turning vehicles and the numbers of incoming and outgoing vehicles at the 4-way crossing, and means for performing a calculation, using equations relative to volumes of traffic per signal light cycle at a 4-way crossing together with two independent values representing the numbers of left-turning and right-turning vehicles, necessary values representing the numbers of incoming and outgoing vehicles per each signal phase of individual roads, so as to calculate 6 values representing the numbers of vehicles which continue running in individual directions.

36. A traffic flow measuring apparatus according to claim 35, wherein said calculation performed using equations relative to volumes of traffic per signal light cycle at an m-way crossing includes values of switching timing of a signal of a traffic signal and a delay time due to different positions of measurement for a given vehicle.

37. A traffic flow measuring apparatus comprising:

image input means for taking images of scenes near a 4-way crossing;

image processing means for executing various image processings for said images taken in said image input means, extracting data representing possible vehicles and providing characteristic quantities of said possible vehicles;

measuring means for determining position data of a vehicle based on said characteristic quantities obtained from said image processing means, for tracking said vehicles by use of said position data and for calculating the moving number of vehicles in at least one direction in which vehicles run; and control means for controlling a signal on the basis of an output of said measuring means;

wherein said measuring means includes means for determining the numbers of left-turning and right-turning vehicles and the numbers of incoming and outgoing vehicles at the 4-way crossing, and means for performing a calculation, using equations relative to volumes of traffic per signal light cycle at a 4-way crossing together with two independent values representing the numbers of left-turning and right-turning vehicles, necessary values representing the numbers of incoming and outgoing vehicles for each signal phase of individual roads, so as to calculate 6 values representing the numbers of vehicles which continue running in individual directions.

38. A traffic flow measuring apparatus according to claim 37, wherein said calculation performed using equations relative to volumes of traffic per signal light cycle at an m-way crossing includes values of switching timing of a signal of a traffic signal and a delay time due to different positions of measurement for a given vehicle.

* * * * *